US010780333B2

(12) United States Patent
Welch et al.

(10) Patent No.: US 10,780,333 B2
(45) Date of Patent: Sep. 22, 2020

(54) SPACER SYSTEM FOR A WEIGHT LIFTING APPARATUS

(71) Applicant: MAXIMUM RANGE OF MOTION, LLC, Phoenix, AZ (US)

(72) Inventors: Mark P. Welch, Syracuse, NY (US); Thomas W. Welch, Phoenix, AZ (US); Robert Holcombe, Scottsdale, AZ (US)

(73) Assignee: MAXIMUM RANGE OF MOTION, LLC, Phoenix, AZ (US)

( * ) Notice: Subject to any disclaimer, the term of this patent is extended or adjusted under 35 U.S.C. 154(b) by 31 days.

(21) Appl. No.: 16/023,946

(22) Filed: Jun. 29, 2018

(65) Prior Publication Data

US 2019/0001212 A1 Jan. 3, 2019

Related U.S. Application Data

(60) Provisional application No. 62/526,534, filed on Jun. 29, 2017.

(51) Int. Cl.
*A63B 21/072* (2006.01)
*A63B 21/078* (2006.01)
(Continued)

(52) U.S. Cl.
CPC ..... *A63B 71/0054* (2013.01); *A63B 21/0626* (2015.10); *A63B 21/0724* (2013.01); *A63B 21/0783* (2015.10); *A63B 2071/009* (2013.01); *A63B 2071/0081* (2013.01); *A63B 2210/50* (2013.01)

(58) Field of Classification Search
CPC ..... A63B 71/0054; A63B 21/0783; A63B 21/0724; A63B 21/0626; A63B 2210/50; A63B 2071/0081; A63B 2071/009; A63B 21/062–0632; A63B 21/072–0783; A63B 21/0004
See application file for complete search history.

(56) References Cited

U.S. PATENT DOCUMENTS 2,991,096 A * 7/1961 Davidson ..... F16L 27/127 403/365
4,579,337 A * 4/1986 Uyeda ..... A63B 21/0728 482/107
(Continued)

*Primary Examiner* — Andrew S Lo
(74) *Attorney, Agent, or Firm* — Bond Schoeneck & King, PLLC; George McGuire; Erin Phillips

(57) ABSTRACT

A spacer apparatus for maximizing a user's range of motion on a weightlifting exercise machine. The spacer apparatus includes a first interlocking part having a semi-circular body extending between top and bottom portions, and a lock portion extending between first and second ends of the semi-circular body. The first and second ends are spaced and a keyway is between the first and second ends. The spacer apparatus includes a second interlocking part having a body extending, at least partially, between first and second ends, and entirely between top and bottom portions. The body of the second interlocking part has a semi-circular portion with a key portion extending therefrom. In the interlocked configuration, the key portion extends between the keyway such that an outer perimeter of the first interlocking part and an outer perimeter of the second interlocking part are aligned.

14 Claims, 66 Drawing Sheets

(51) Int. Cl.
*A63B 71/00* (2006.01)
*A63B 21/062* (2006.01)

(56) References Cited

U.S. PATENT DOCUMENTS 4,585,367 A * 4/1986 Gall ..... A63B 21/0728 403/104
4,639,979 A * 2/1987 Polson ..... A63B 21/0728 24/273
4,738,446 A * 4/1988 Miles ..... A63B 21/0728 24/580.11
4,971,318 A * 11/1990 Tracy ..... A63B 21/0728 482/107
5,062,631 A * 11/1991 Dau ..... A63B 21/0728 403/330
5,295,933 A * 3/1994 Ciminski ..... A63B 21/0728 24/270
5,591,109 A * 1/1997 Strnad ..... A63B 21/0728 24/524
5,735,777 A * 4/1998 Benoit ..... A63B 21/0728 482/106
6,902,517 B1 * 6/2005 Brown ..... A63B 21/0728 482/106
7,494,451 B1 * 2/2009 Ramos ..... A63B 21/0728 482/107
7,789,814 B1 * 9/2010 Xu ..... A63B 21/0728 482/107
8,671,530 B2 * 3/2014 Ciminski ..... A63B 21/0728 24/273
8,827,878 B1 * 9/2014 Ciminski ..... A63B 21/0728 482/107
9,662,530 B2 * 5/2017 Dimitrov ..... A63B 21/0728
10,004,970 B1 * 6/2018 Mailander ..... A63B 71/0054
10,512,815 B2 * 12/2019 Stilson ..... A63B 21/0728
2008/0287271 A1 * 11/2008 Jones ..... A63B 21/0728 482/107
2016/0375295 A1 * 12/2016 Brasch et al. ..... A63B 21/0728 482/107
2017/0135428 A1 * 5/2017 Beckman ..... A63B 21/0728
2019/0046831 A1 * 2/2019 Coury ..... A63B 1/00

* cited by examiner

SPACER SYSTEM FOR A WEIGHT LIFTING APPARATUS

CROSS-REFERENCE TO RELATED APPLICATION

The present application relates and claims priority to U.S. Provisional Patent Application Ser. No. 62/526,534 filed Jun. 29, 2017, the entirety of which is hereby incorporated by reference.

BACKGROUND OF THE INVENTION

1. Field of the Invention

The present invention relates generally to weightlifting exercise machines, and more particularly to an apparatus for maximizing the user's range of motion on a Smith Machine, which has a guided weight bar or exercise bar used to simulate a free weight barbell.

2. Description of Related Art

Currently, there are several variations of Smith Machines in use including, but not limited to, some with vertical guide rods running perpendicular to the floor (an example of which is shown and described in U.S. Pat. No. 7,713,179), and also modified versions of Smith Machines that place the vertical guide rods at a plurality of varying slight angles relative to the floor. Additionally, there are other Smith Machines which have those and more variations of the vertical guide rods, including dual action systems which allow for vertical and horizontal exercise motions at the same time while doing exercise movements and weightlifting.

On Smith Machines, the barbell is typically similar to an Olympic barbell, which is horizontally mounted by connections on the left side and on the right side of the barbell to a vertical guide rod sleeve, which goes around the vertical guide rod on each side of the Smith Machine. The barbell typically has a latch, latch assembly, hook, or similar mechanism attached on its left and right sides, which the user can latch to stop the descent of the barbell. Generally, the latch is locked by rotating the barbell, or a part of the barbell wherein the hooks are attached, to latch the hooks into, onto, or over catches (e.g., catch slots, pegs, pins, or other catch points) on the left and right vertical frame members of the Smith Machine. Thus, if the user needs to stop the barbell from descending during Smith Machine exercises, they can latch the hooks with or onto the catch points.

In using conventional Smith Machines, the descent of the barbell is stopped by the user's ability to roll his/her wrists and/or hands to latch the hooks with the catches. Further, users who strive to increase their strength and lifting capacity do so by attempting to lift more weight than the heaviest they have ever lifted in the past or the user lifts the same prior maximum weight amount but increases the number of repetitions of the exercise to reach a personal best or personal record to grow stronger. In both scenarios, the user is attempting to lift more total weight (i.e., in weight on the barbell or number of repetitions) in a single exercise session than the user has lifted previously and increasing the total weight or repetitions increases the potential for the user to drop or otherwise have the barbell free fall under the stress of added total weight.

The user may drop or otherwise release the barbell causing it to free fall onto himself/herself due to many reasons, such as weakness in the arms, the slipping of one or more hands from the barbell, fatigue, failure to roll his/her wrists and/or hands to latch the hooks with the catches, and incomplete or partial latching that slips off the catches. A free fall of the barbell can cause significant injury to the user if the falling barbell drops onto or otherwise contacts the user's body. Generally, safety stops are used along the guide rods of the Smith Machine and positioned at a vertical height to stop the barbell before striking the user's body. If the barbell becomes unlatched or the user releases the barbell, the barbell will descend along the guide rods until the barbell guide rod sleeves come into contact with the safety stops if they are set at the appropriate height. With the safety stops appropriately positioned, the safety stops prevent contact between the free falling barbell and the user.

With conventional Smith Machines, the safety stops are spaced at equal height intervals around or adjacent to the guide rods. Thus, the user must latch the safety stops at the appropriate height so the barbell does not contact the user's chest, clavicles, shoulders, and other body parts (depending on the Smith Machine exercise). Because the safety stops catch heights settings are preset by the Smith Machine manufacturers evenly spaced at equal height intervals, the closest safety stop catch height for a desired exercise may be too low, allowing the barbell to come into contact with the user's body, and the next higher safety stop catch setting may be too high, causing the barbell to stop several inches above those respective body parts and depriving the user of their full extension range of motion and their full flexion range of motion during the Smith Machine exercise. This applies to a variety of Smith Machine exercises.

This creates a loss of tension or load that would be applied to the muscle during a full extension range of motion and full flexion range of motion during the exercise because the user could not bring the barbell as close to his/her body as possible, during the flexion and extension motions. This deprives the user of maximum tension on the muscle during full range of motion. As a result, the user is also deprived of movement fluidity. The ability to train any muscle through a full range of motion helps prevent future injury.

When the exercise involves a pressing or pushing of the barbell, or when the exercise involves a lifting or pulling of the barbell, that loss of an inch to several inches of range of motion on the barbell descent is matched by the loss of an inch to several inches where the barbell is raised. During that missed flexion range of motion and missed extension range of motion, the lost load is not applied to the muscle. The lost load that could have been applied to the muscle during the full range of motion is critical to maximize the growth of type 1 muscle fibers.

Further, if the muscles of the user get stronger through the shortened range of motion on a Smith Machine and the user then switches to free weight exercises, the user will likely not be able to lift as much load as he/she did on the Smith Machine. This could cause injury to the user because he/she is not used to the full range of motion free weight exercises with the same load.

Another problem with the safety stops on the Smith Machines is that Smith Machines are generated by numerous manufacturers. Although each manufacturer generally has a Smith Machine with equally spaced safety stop setting heights, the interval or distance between each safety stop setting height varies. For example, one company may have a Smith Machine with 4 inches between each safety stop setting height while another company may have a Smith Machine with 6 inches between each safety stop setting height. Thus, if a user performs exercises on two or more different Smith Machines, his/her shortened range of motion is constantly changing. Therefore, a user is forced to either exercise at various shortened ranges of motion or choose not to use to the safety stops, which puts the user at risk of injury. If the user chooses not to use the safety stops, the user may elect to lift less weight to decrease the risk of dropping the barbell, which deprives the user of the opportunity to achieve his/her personal best or personal record and improve strength and muscle development.

Therefore, there is a need for a system and method for a spacer system functioning with safety stops used on a Smith Machine, to maximize the user's range of motion.

All exercise definitions used herein, as should be understood by a person of ordinary skill in the art in conjunction with review of this disclosure, are defined as described in Baechle, T., Earl, R. (2008). *Essentials of Strength and Conditioning*. Omaha, NB, National Strength and Conditioning Association.

Description of the Related Art Section Disclaimer: To the extent that specific patents/publications/products are discussed above in this Description of the Related Art Section or elsewhere in this Application, these discussions should not be taken as an admission that the discussed patents/publications/products are prior art for patent law purposes. For example, some or all of the discussed patents/publications/products may not be sufficiently early in time, may not reflect subject matter developed early enough in time and/or may not be sufficiently enabling so as to amount to prior art for patent law purposes. To the extent that specific patents/publications/products are discussed above in this Description of the Related Art Section and/or throughout the application, the descriptions/disclosures of which are all hereby incorporated by reference into this document in their respective entirety(ies).

SUMMARY OF THE INVENTION

The present invention is directed to spacer apparatus, inter alia, a spacer apparatus and spacer system for maximizing the user's range of motion on a weightlifting exercise machine, such as a Smith Machine, which has a guided weight bar or exercise bar used to simulate a free weight barbell.

In one embodiment, the apparatus is a spacer apparatus for a weightlifting exercise machine. The spacer apparatus includes a first interlocking part having a semi-circular body extending between top and bottom portions, and a lock portion extending between first and second ends of the semi-circular body. The first and second ends are spaced and a keyway is between the first and second ends. The spacer apparatus includes a second interlocking part having a body extending, at least partially, between first and second ends, and entirely between top and bottom portions. The body of the second interlocking part has a semi-circular portion with a key portion extending therefrom. In the interlocked configuration, the key portion of the second interlocking part extends between the keyway of the first interlocking part such that an outer perimeter of the first interlocking part and an outer perimeter of the second interlocking part are aligned.

In another embodiment, the spacer apparatus for a weightlifting exercise machine comprises a first interlocking part having a first semi-circular body extending between a top portion and a bottom portion with a first lock portion extending between a first end and second end of the first semi-circular body. A first male connector extends from the first end of the first semi-circular body and a first female groove extends into the second end of the first semi-circular body. A second interlocking part has a second semi-circular body extending between a top portion and a bottom portion with a second lock portion extending between a first end and second end of the second semi-circular body. A second female groove extends into the first end of the second semi-circular body and a second male connector extends from the second end of the second semi-circular body. In the interlocked configuration, the first male connector is connected within the second female groove and the second male connector is connected within the first female groove, forming a channel between the first semi-circular body and the second semi-circular body. In the interlocked configuration, the outer perimeter of the first semi-circular body and an outer perimeter of the second semi-circular body are aligned in a circle.

In yet another embodiment, the present invention is a spacer system for a weightlifting exercise machine. The spacer system comprises a first spacer apparatus, including: (i) a first interlocking part with a first body extending between a top portion and a bottom portion and between a first end and second end of the first body; wherein the first end and the second end are spaced; (ii) at least one keyway between the first end and second end; (iii) a second interlocking part having a second body extending between a top portion and a bottom portion, the second body comprising a key portion extending therefrom; wherein in the interlocked configuration, the key portion of the second body extends into the keyway of the first body such that a first channel is formed between the first interlocking part and the second interlocking part; and (iv) an object is slidably received by the first channel.

The spacer system may also include a second spacer apparatus, including: (v) a third interlocking part with a third body extending between a top portion and a bottom portion and between a first end and second end of the third body; wherein the first end and the second end are spaced; (vi) at least one keyway between the first end and second end; (vii) a fourth interlocking part having a fourth body extending between a top portion and a bottom portion, the fourth body comprising a key portion extending therefrom; wherein in the interlocked configuration, the key portion extends into the keyway such that a second channel is formed between the third interlocking part and the fourth interlocking part; and (viii) the object is slidably received by the second channel.

Each spacer apparatus of the spacer system can be added or otherwise installed around an object on an exercise machine, such as a guide rod of a Smith Machine, without disassembly of any of the component parts of the exercise machine. Further, each spacer apparatus of the spacer system can be added or otherwise installed through the use of one human hand, making each spacer apparatus easy-to-use. Further, each spacer apparatus used around a guide rod is totally comprised of two pieces, i.e., two total component parts, which also makes it easy-to-use. Finally, in use, each spacer apparatus produces a Vernier (defined herein as a measurement between two graduations on a scale and the ability to fine tune a larger machine with a smaller apparatus) stack height when on top of the safety stops once the safety stop is set at the preset setting heights for the safety stops on a Smith Machine. There are numerous Vernier stack heights achievable, depending on the number of spacer apparatuses in the spacer system and the length of each component piece (i.e., interlocking part) of each spacer apparatus.

BRIEF DESCRIPTION OF THE DRAWINGS

One or more aspects of the present invention are particularly pointed out and distinctly claimed as examples in the claims at the conclusion of the specification. The foregoing and other objects, features, and advantages of the invention are apparent from the following description taken in conjunction with the accompanying drawings in which:

DETAILED DESCRIPTION OF THE INVENTION

Aspects of the present invention and certain features, advantages, and details thereof, are explained more fully below with reference to the non-limiting examples illustrated in the accompanying drawings. Descriptions of well-known structures are omitted so as not to unnecessarily obscure the invention in detail. It should be understood, however, that the detailed description and the specific non-limiting examples, while indicating aspects of the invention, are given by way of illustration only, and are not by way of limitation. Various substitutions, modifications, additions, and/or arrangements, within the spirit and/or scope of the underlying inventive concepts will be apparent to those skilled in the art from this disclosure.

All exercise definitions used herein, as should be understood by a person of ordinary skill in the art in conjunction with review of this disclosure, are defined as described in Baechle, T., Earl, R. (2008). *Essentials of Strength and Conditioning*. Omaha, NB, National Strength and Conditioning Association.

The present invention allows the user to achieve the most out of their exercises in a safe manner and when pushing themselves to the extreme to maximize their physical and strength development when using a weightlifting exercise machine alone. The present invention provides a portable, lightweight, and easy-to-use means to achieve a full extension and full flexion range of motion while doing exercises on the weightlifting exercise machine. An example weightlifting exercise machine, such as that shown in U.S. Pat. No. 5,669,859, comprises basic features, including a weight bar (e.g., barbell) which extends horizontally on a pair of vertical guide tracks (e.g., guide rods). The machine can also comprise a safety catch or safety stop mechanism that latches onto pins (or other features or protrusions) located on upright brace supports, which are spaced from and aligned with the vertical guide tracks. The present invention can be added onto or otherwise installed on any such weightlifting exercise machine. However, for clarity, the present invention is described in detail below for addition or installation onto a Smith Machine, an exemplary type of weightlifting exercise machine.

Referring to the Figures, the present invention is an interlocking, incrementally, stackable spacer system to be used on Smith Machines to allow a user to get a full range of motion, and to allow the user to intentionally increase or decrease their range of motion at approximate one-inch increments so they can perform exercises until exhaustion and/or failure, thereby maximizing the user's range of motion, physical development, hypertrophy, and strength in a safe manner while doing Smith Machine exercises on Smith Machines alone.

Figure 1:
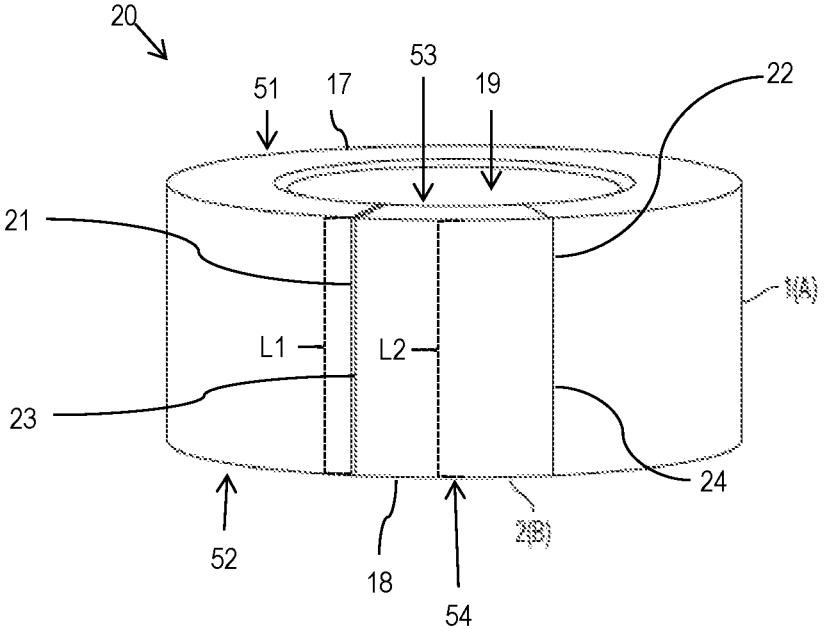
FIG. 1 is a perspective front view schematic representation of a spacer apparatus of a spacer system in an interlocked configuration, according to an embodiment.
Figure 2:
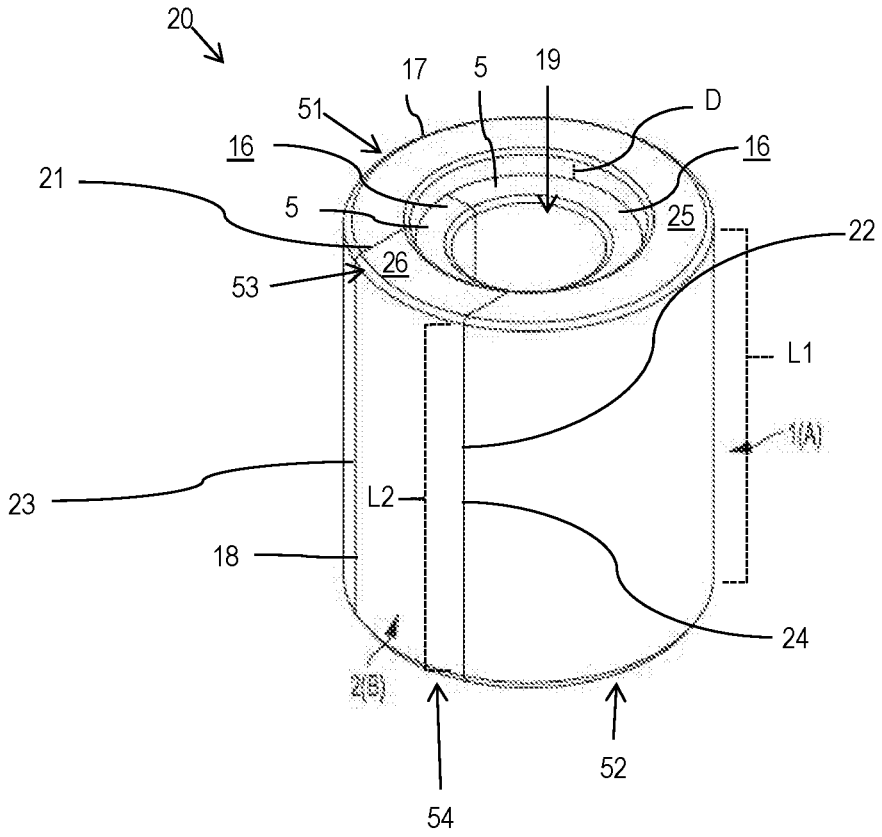
FIG. 2 is an elevated perspective side view schematic representation of the spacer apparatus in the interlocked configuration, according to an embodiment.

Referring first to FIGS. 1-2, there is shown a perspective side elevated view and a perspective side elevated view schematic representations, respectively, of a spacer apparatus 20 of a spacer system, in an interlocked configuration. As shown in FIGS. 1-2, the spacer apparatus 20 comprises a first interlocking part 1(A) in an interlocked configuration with an interlocking part 2(B). The first interlocking part 1(A) has a solid semi-circular or semi-tubular body 17, with an outer length L1, extending between a top portion 51 and a bottom portion 52 of the first interlocking part 1(A). The body 17 of the first interlocking part 1(A) also extends between a first end 21 and a second end 22 of the first interlocking part 1(A). The second interlocking part 2(B) has a smaller, solid semi-circular or semi-tubular body 18, with an outer length L2, extending between a top portion 53 and a bottom portion 54 of the second interlocking part 2(B). The body 17 of the second interlocking part 2(B) also extends, at least partially, between a first end 23 and a second end 24 of the second interlocking part 2(B). The interlocking parts 1(A), 2(B) can be formed from metal for strength and durability; although other materials can be used for the spacer system construction. In the depicted embodiment, in the interlocked configuration, a channel 19 extends between and through the interlocked parts 1(A), 2(B) of the spacer apparatus 20. In the depicted embodiment, the circular or tubular; however, any other suitable shape or configuration may be used.

The spacer system 100 (shown in FIG. 29) may include may include one or more of the spacer apparatus 20 shown in FIGS. 1-2. In each spacer apparatus the length L1 of the first interlocking part 1(A) may be equal to, less than, or greater than the length L2 of the second interlocking part 2(A). In the embodiment depicted in FIGS. 1-2, L1 is equal to L2. Further, L1 and L2 may vary for each spacer apparatus 20 in the spacer system 100, as will be described in detail below.

Figure 3:
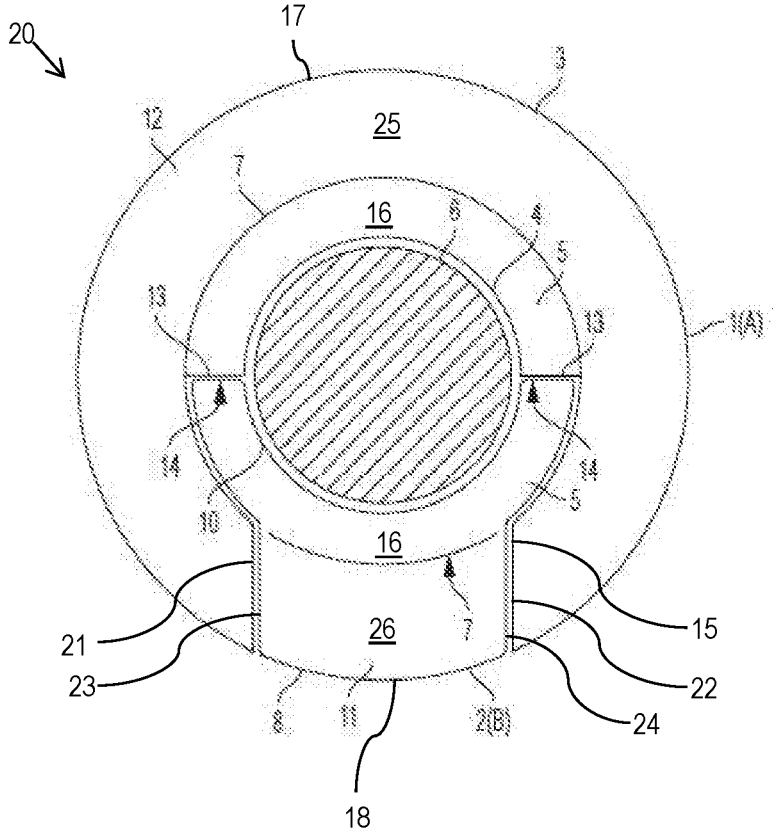
FIG. 3 is a top (and/or bottom) view schematic representation of the spacer apparatus in the interlocked configuration around an object, according to an embodiment.

Turning to FIG. 3, there is shown a top (and/or bottom) view schematic representation of the spacer apparatus 20 in the interlocked configuration around an object 6, according to an embodiment. In the embodiment shown in FIG. 3, the first interlocking part 1(A) is in the interlocked configuration, interlocked with the second interlocking part 2(B) (as shown in FIGS. 1-2), but the interlocking parts 1(A), 2(B) are interlocked around an object 6, such as a guide rod of the Smith Machine. In the depicted embodiment, the body 17 of the first interlocking part 1(A) comprises an outer perimeter 3, which is substantially flush and aligned with an outer perimeter 8 of the body 18 of the second interlocking part 2(B). In FIG. 3, the outer perimeters 3, 8 form a circle when the interlocking parts 1(A), 2(B) are in the interlocked configuration. In one embodiment, the outer perimeters 3, 8 are chamfered. Specifically, the edges where the first ends 21, 23 and the second ends 22, 24 of the interlocking parts 1(A), 2(B) meet the outer perimeters 3, 8 are chamfered.

Still referring to FIG. 3, the body 17 of the first interlocking part 1(A) has an inner perimeter 4. In one embodiment, the inner perimeter 4 is chamfered and in particular, edges of and where the first and second ends 21, 22 of the first interlocking part 1(A) meet the outer countersunk perimeter 7 are chamfered. Similarly, the body 18 of the second interlocking part 2(B) has as inner perimeter 10. The edges where the first and second ends 23, 24 of the second interlocking part 2(B) meet the inner perimeter 10 are chamfered, in some embodiments.

As shown in FIGS. 2-3, the interlocking parts 1(A), 1(B) comprise countersunk areas 5. The first interlocking part 1(A) comprises a countersunk area 5 in the body 17 partially between its inner perimeter 4 and the outer perimeter 3. Specifically, the countersunk area 5 in the body 17 extends between the inner perimeter 4 of the body 17 and an outer countersunk perimeter 7 of the body 17. As shown in FIGS. 2-3, the outer countersunk perimeter 7 is between the inner perimeter 4 and the outer perimeter 3. Similarly, the second interlocking part 2(B) comprises a countersunk area 5 partially between its inner perimeter 10 and outer perimeter 8. Specifically, the countersunk area 5 in the body 18 extends between the inner perimeter 10 of the body 18 and an outer countersunk perimeter 7 of the body 18. As shown in FIGS. 2-3, the outer countersunk perimeter 7 is between the inner perimeter 10 and the outer perimeter 8. The countersunk area 5 of the interlocking parts 1(A), 2(B) extend within the interlocking parts 1(A), 2(B) such that a top surface 16 of the countersunk areas 5 is at a depth D relative to the top surfaces 25, 26 of the interlocking parts 1(A), 2(B), as shown in FIG. 2. In the depicted embodiment, the countersunk areas 5 comprise a flat top surface 16; however alternative textures are contemplated for the countersunk areas 5. As shown in FIG. 3 and recited above, the countersunk area 5 of the interlocking parts 1(A), 2(B) extend from the inner perimeters 4, 10 and extend to the outer countersunk perimeter 7 of the interlocking parts 1(A), 2(B). Thus, in the interlocked configuration shown in FIG. 3, the outer countersunk 7 forms a circle.

It is important to note that in the interlocked configuration in the embodiment shown in FIG. 3, is a top and/or bottom view of the spacer apparatus 20 and the top and/or bottom view will appear the same as shown in FIG. 3. Thus, in the interlocked configurations, the top portion 51 of the first interlocking part 1(A) may be aligned or otherwise adjacent the top portion 53 of the second interlocking part 2(B), as shown in FIG. 2. Or, in another interlocked configuration, the top portion 51 of the first interlocking part 1(A) is upright and aligned and interlocked with the bottom portion 54 of the second interlocking part 2(B), when the second interlocking part 2(B) is turned upside down (i.e., rotated 180 degrees). Or, in another interlocked configuration, the top portion 51 of the first interlocking part 1(A) is turned upside down (i.e., rotated 180 degrees) and aligned and interlocked with the second interlocking part 2(B) when it is upright with the top portion 53 on top. Or, in yet another interlocked configuration, the top portion 51 of the first interlocking part 1(A) is turned upside down (i.e., rotated 180 degrees) and aligned and interlocked with the top portion 53 of the second interlocking part 2(B) when it is turned upside down (i.e., rotated 180 degrees). Therefore, in the unlocked configuration, one (or both) of the interlocking parts 1(A), 2(B) may be rotated 180 degrees and the interlocking parts 1(A), 2(B) can still achieve the interlocked configuration.

Figure 4:
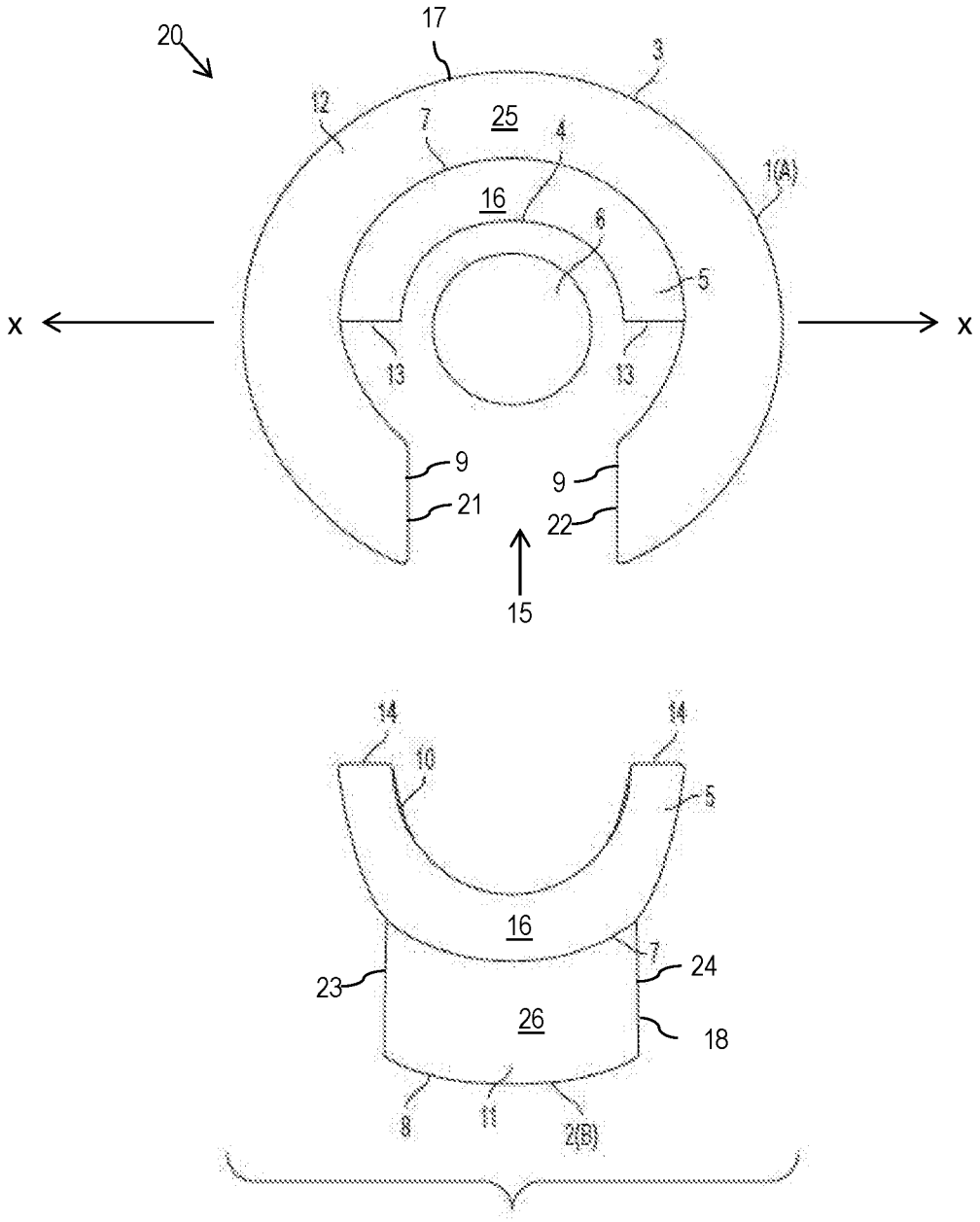
FIG. 4 is a top (and/or bottom) view schematic representation of the spacer apparatus in the unlocked configuration, according to an embodiment.

Referring now to FIG. 4, there is shown a top (and/or bottom) view schematic representation of the spacer apparatus in the unlocked configuration, according to an embodiment. As shown, the body 18 of the second interlocking part 2(B) comprises a key portion 11, which extends from the countersunk area 5, forming a "Y" shape in the body 18 of the second interlocking part 2(B). In the depicted embodiment, the key portion 11 extends from the outer countersunk perimeter 7 of the body 18. As also shown in FIG. 4, in the unlocked configuration, the first interlocking part 1(A) comprises a keyway 15. The keyway 15 is a gap or other recess in the first interlocking part 1(A) sized or otherwise dimensioned to accommodate the body 18 of the second interlocking part 2(B).

As shown in FIG. 4, the countersunk area 5 of the first interlocking part 1(A) comprises a first pair of countersunk ends 13. The countersunk area 5 of the second interlocking part 2(B) comprises a second pair of countersunk ends 14. In the depicted embodiment, in the unlocked configuration, the keyway 15 extends starting from between the first and second ends 21, 22 at the outside perimeter 3 of the first interlocking part 1(A) and up to the inner perimeter 4 and the first pair of countersunk ends 13 of the first interlocking part 1(A).

From the unlocked configuration shown in FIG. 4, the "Y" shaped body 18 of the second interlocking part 2(B) is placed within the keyway 15 of the first interlocking part 1(A) to achieve the interlocked configuration shown in FIGS. 1-3. In one embodiment, to place the body 18 of the second interlocking part 2(B) into the keyway 15, the body 18 is aligned over (e.g., at a height above) the keyway 15 of first interlocking part 1(A) and is then slidably moved within the keyway 15 to achieve the interlocked configuration shown in FIGS. 1-3. In the interlocked configuration, as shown in FIG. 3, the outer perimeters 3, 8, inner perimeters 4, 10, and outer countersunk perimeters 7 are aligned. In the depicted embodiment, the outer perimeters 3, 8, inner perimeters 4, 10, and outer countersunk perimeters 7 form circles. However, alternative configurations for the perimeters are contemplated.

In addition, in the interlocked configuration shown in FIG. 3, the key portion 11 of the second interlocking part 2(B) is substantially flush and aligned with a lock portion 12 of the body 17 of the first interlocking part 1(A). The lock portion 12 extends between the outer countersunk perimeter 7 and the outer perimeter 3 of the first interlocking part 1(A). Further, the countersunk areas 5 of the interlocking parts 1(A), 2(B) are substantially flush and aligned. Specifically, the top surfaces 16 of the countersunk areas 5 are substantially flush and aligned at depth D from (or lower relative to) the top surfaces 25, 26 of the interlocking parts 1(A), 2(B), as shown in FIG. 2. In addition, in the interlocked configuration, as shown FIG. 3, the first pair of countersunk ends 13 abuts the second pair of countersunk ends 14 within the keyway 15.

Referring now to FIGS. 5A-5D and FIGS. 6A-6D, there are shown various views schematic representation of the first interlocking part 1(A) and the second interlocking part 2(B), respectively, with chamfered edges. Turning first to FIGS. 5A-5D, the first interlocking part 1(A) comprises a first pair of edges 27 where the outer perimeter 3 meets the top surface 25 (and bottom surface (not shown)) of the lock portion 12 of the body 17, a second pair of edges 28 where the outer countersunk perimeter 7 meets the top surface 25 (and bottom surface (not shown)) of the lock portion 12 of the body 17, and a third pair of edges 29 where the inner perimeter 4 meets the top surface 16 of the countersunk area 5. In the embodiment shown in FIGS. 5A-5D, the first, second, and third pair of edges 27, 28, 29 are chamfered.

Similarly, as shown in FIGS. 6A-6D, the second interlocking part 2(B) also comprises a first pair of edges 31 where the outer perimeter 8 meets the top surface 26 (and bottom surface (not shown)) of the key portion 11 of the body 18, a second pair of edges 32 where the outer countersunk perimeter 7 meets the top surface 26 (and bottom surface (not shown)) of the key portion 11 of the body 18, and a third pair of edges 33 where the inner perimeter 10 meets the top surface 16 of the countersunk area 5. In the embodiment shown in FIGS. 6A and 6D, the first, second, and third pair of edges 31, 32, 33 are chamfered.

In an embodiment, the chamfering placement in certain areas can be critical to the stability and safety of the spacer apparatus 20. For example, in an embodiment of the spacer apparatus 20 of FIGS. 5A-6D wherein in the interlocked configuration (FIG. 2), a diameter of the channel 19 is 1.504 inches, a diameter of the circle formed by the outer countersunk perimeter 7 is 1.804 inches, a diameter of the circle formed by the outer perimeters 3, 8 is 3.205 inches, and a length (L1 and L2) of the spacer apparatus 20 is 2 inches, and offset load tested, the stability and safety data is provided in Table 1 below.

TABLE 1

Safety and Stability Data

| Weight (lbs) | Dropping Distance (ft.) | Impact Force (lbs) | Maximum Stress (psi) | Factor of Safety (7075 Al) | Factor of Safety (6061 Al) |
|---|---|---|---|---|---|
| 750 | 7 | 20,382 | 14,208 | 4.9 | 2.5 |
| 750 | 6 | 18,663 | 13,011 | 5.4 | 2.7 |

TABLE 1-continued

Safety and Stability Data

| Weight (lbs) | Dropping Distance (ft.) | Impact Force (lbs) | Maximum Stress (psi) | Factor of Safety (7075 Al) | Factor of Safety (6061 Al) |
|---|---|---|---|---|---|
| 750 | 5 | 16,940 | 11,810 | 5.9 | 3.0 |
| 750 | 4 | 15,220 | 10,610 | 6.6 | 3.3 |
| 750 | 3 | 13,500 | 9,411 | 7.4 | 3.7 |

A factor of safety (FoS) or, interchangeably, a safety factor (SF), is a measure describing the load carrying capacity of a system beyond the expected or actual loads. In other words, the FoS (or SF) is how many times stronger the system is than it needs to be for its intended load. In this example, as can be seen from Table 1, the 2-inch spacer apparatus 20 can withstand at least 2.5 times its expected load, when made of 6061 Aluminum, when 750 lbs is dropped from a height of 7 feet onto the spacer apparatus 20 with the contact area the end of a 2" diameter "schedule 40 pipe." The FoS (or SF) is only increased using a different type of aluminum composition (7075 Al) for the spacer apparatus 20, also the FoS (or SF) is increased if using the same aluminum composition (6061 AL for example) but the height of the dropping distance is less. Thus, the data in Table 1 indicates that the spacer apparatus 20 is a substantially safe and stable spacer device for use on a Smith Machines. Further, the safety and stability, as shown in Table 1, is provided on a relatively small and portable spacer apparatus 20.

The Safety and Stability Data in the corresponding exemplary chart above in Table 1 shows the testing results for the spacer apparatus(es) 20 used around only one barbell guide rod, and on top of the one safety stop, so the Factors of Safety or Safety Factors shown in the chart are only half of the actual total weight capacity of the spacer apparatus(es) 20 when used together at matching heights around each on each barbell guide rod and on top of the two safety stops found on the left and right.

The testing was done using 750 pounds being dropped at the noted heights for each guide rod. Since there are two guide rods with one on each side, the Factor of Safety or Safety Factor for the testing results actual apply to 1,500 pounds (750 plus 750 pounds for each side.)

Figure 5A:
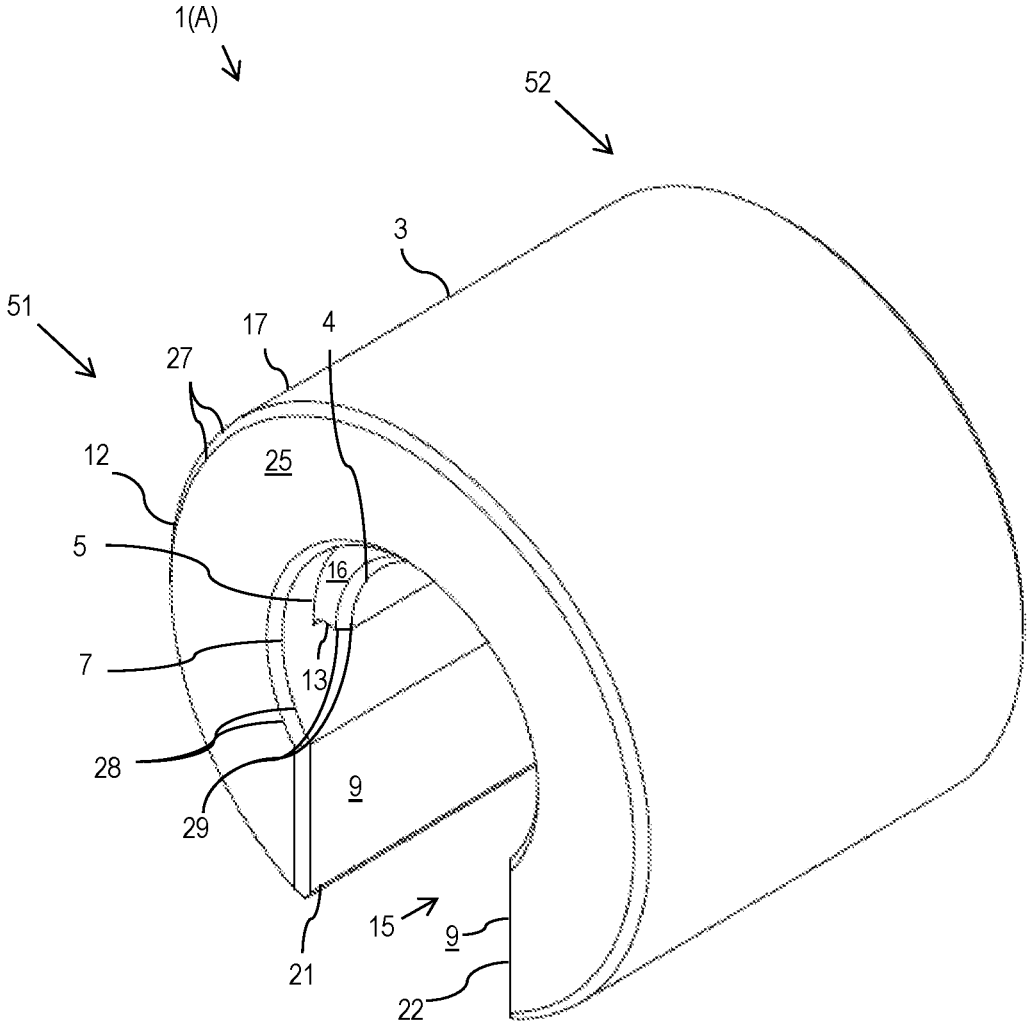
FIG. 5A is a perspective side view schematic representation of the first interlocking part, according to an embodiment.
Figure 5B:
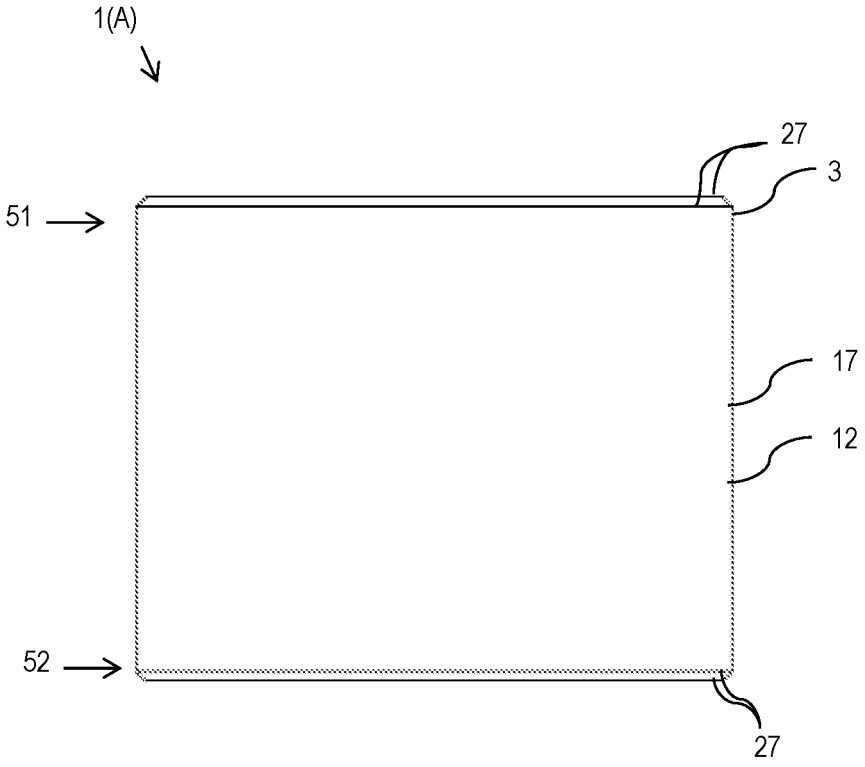
FIG. 5B is a back view schematic representation of the first interlocking part of FIG. 5A.
Figure 5C:
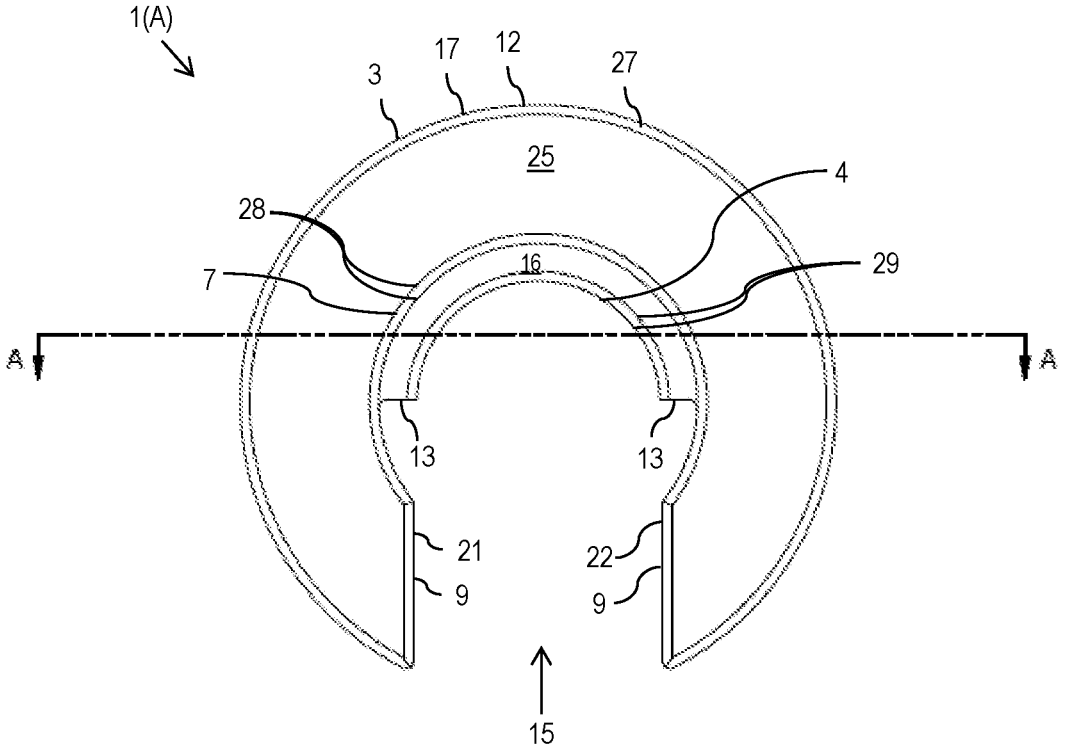
FIG. 5C is a top view schematic representation of the first interlocking part of FIG. 5A.
Figure 5D:
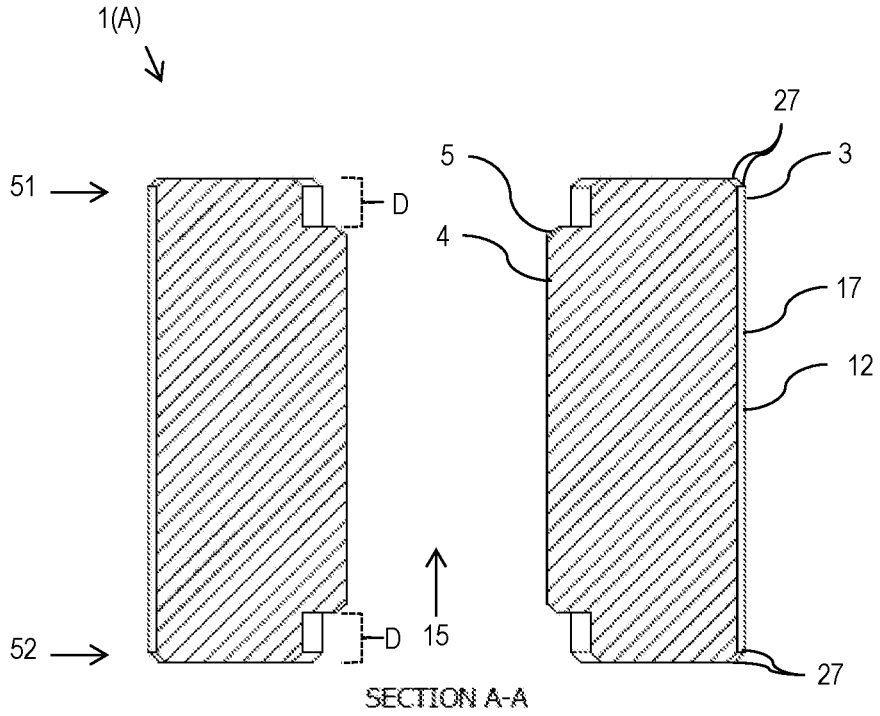
FIG. 5D is a cross-sectional view schematic representation at line A-A through the first interlocking part of FIG. 5C.
Figure 6A:
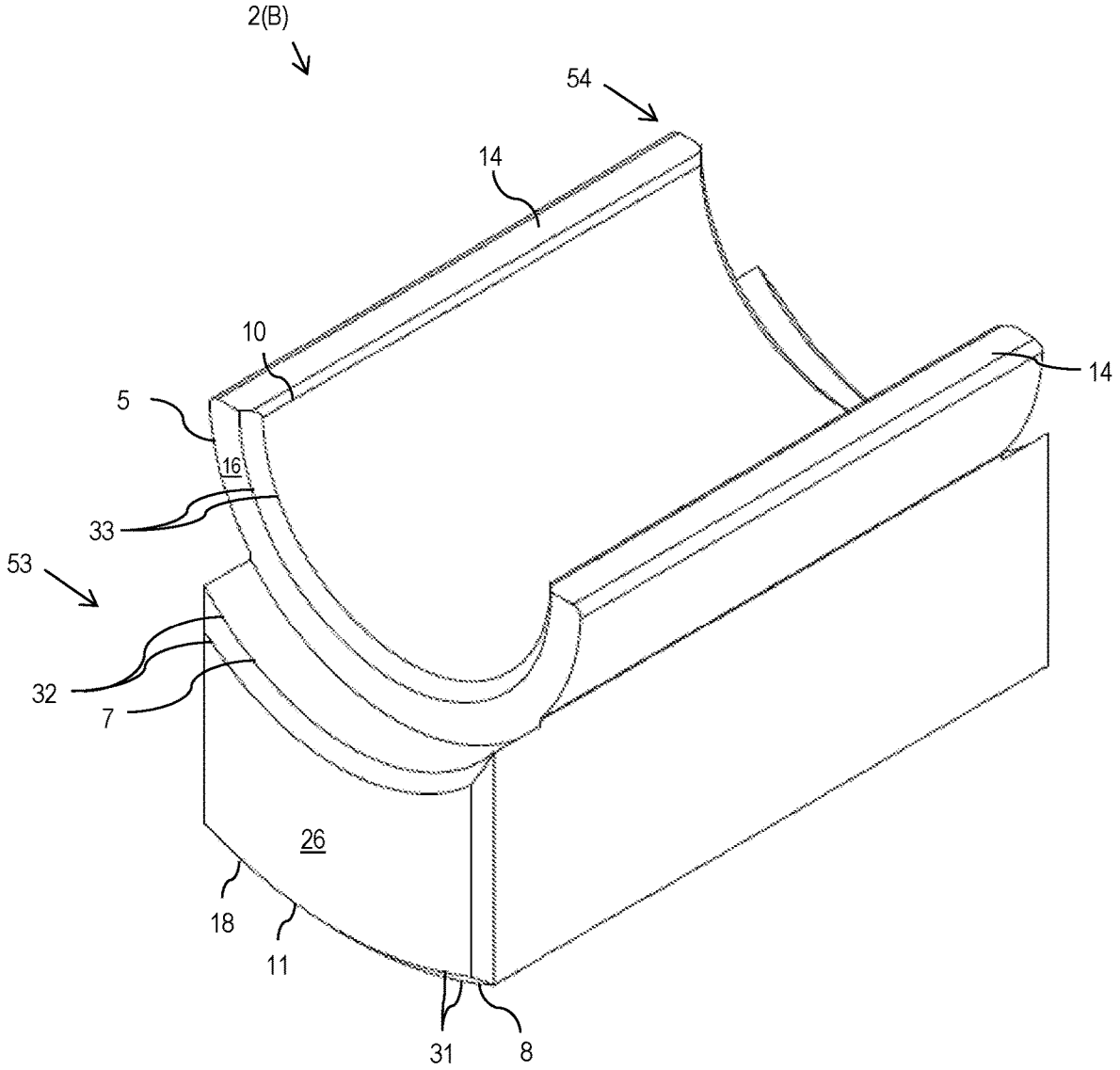
FIG. 6A is perspective side angled view schematic representation of the second interlocking part, according to an embodiment.
Figure 6B:
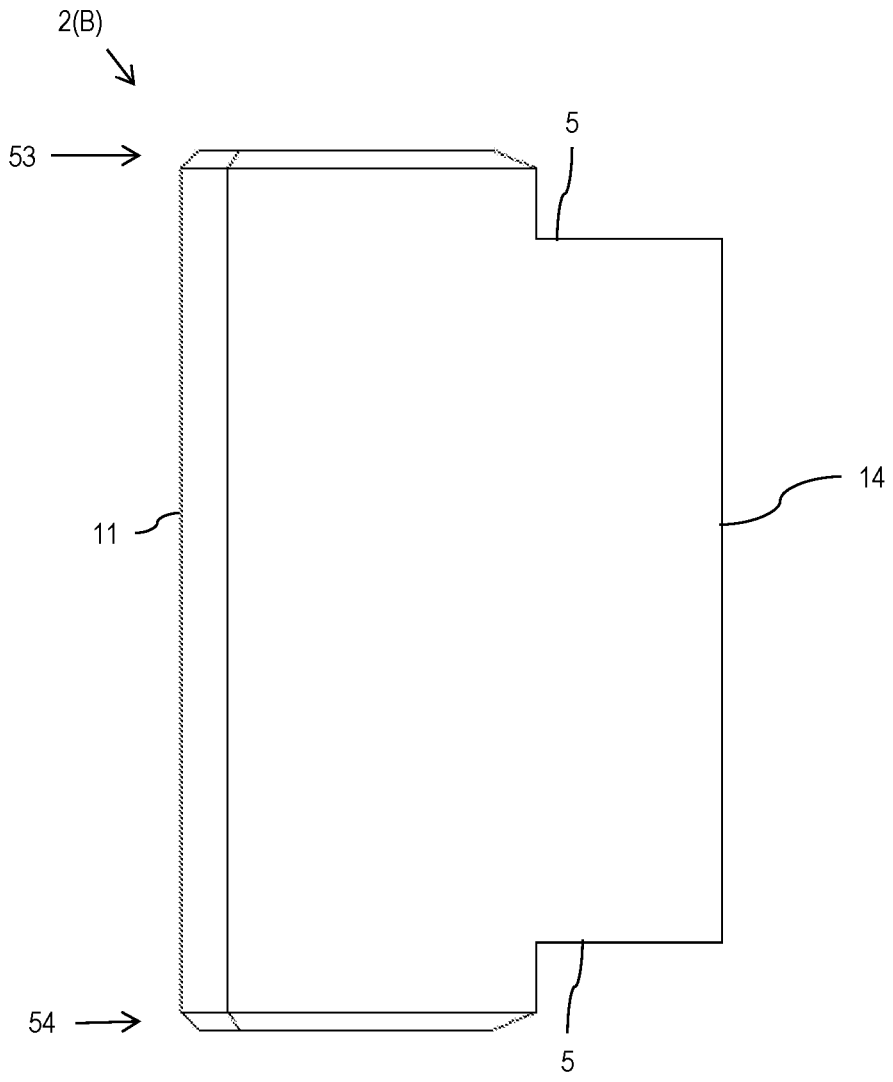
FIG. 6B is a side view schematic representation of the second interlocking part of FIG. 6A.
Figure 6C:
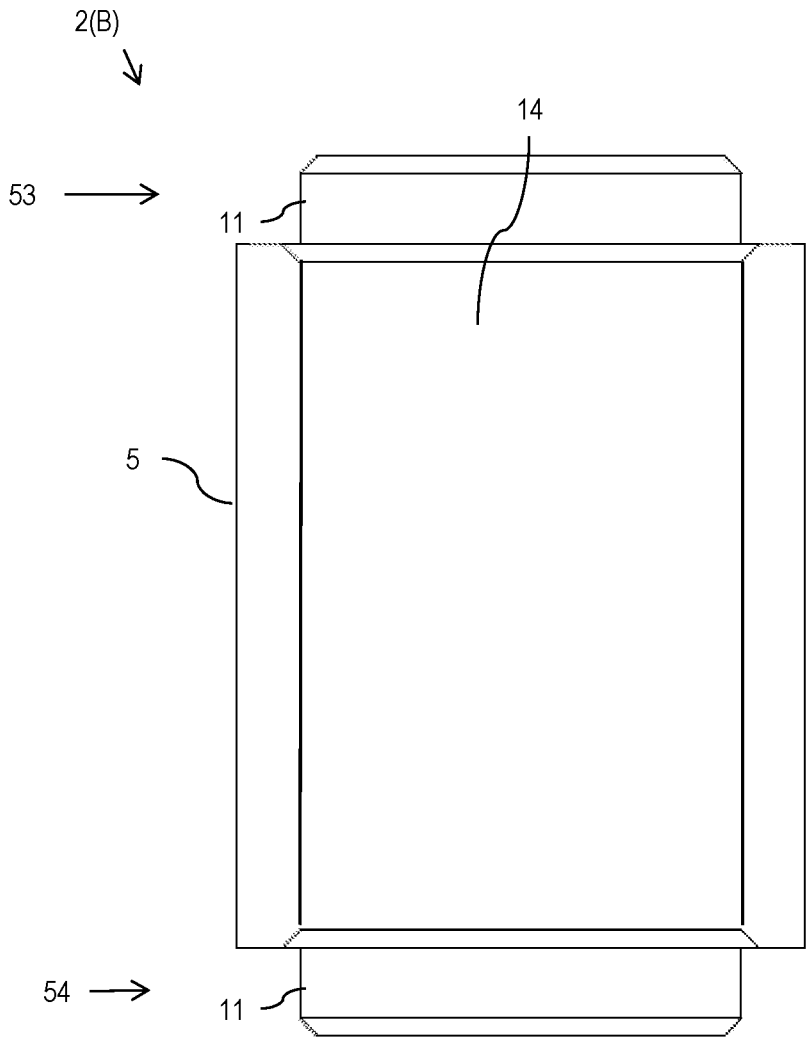
FIG. 6C is a front view schematic representation of the second interlocking part of FIG. 6A.
Figure 6D:
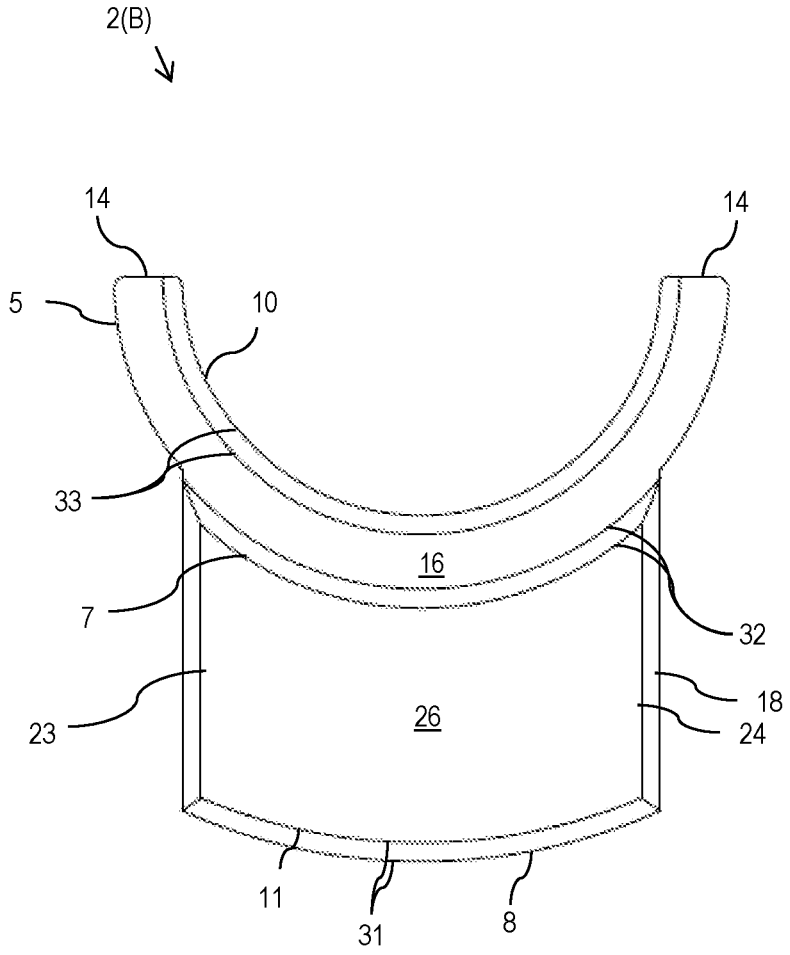
FIG. 6D is a top (and/or bottom) view schematic representation of the second interlocking part of FIG. 6A.
Figure 7A:
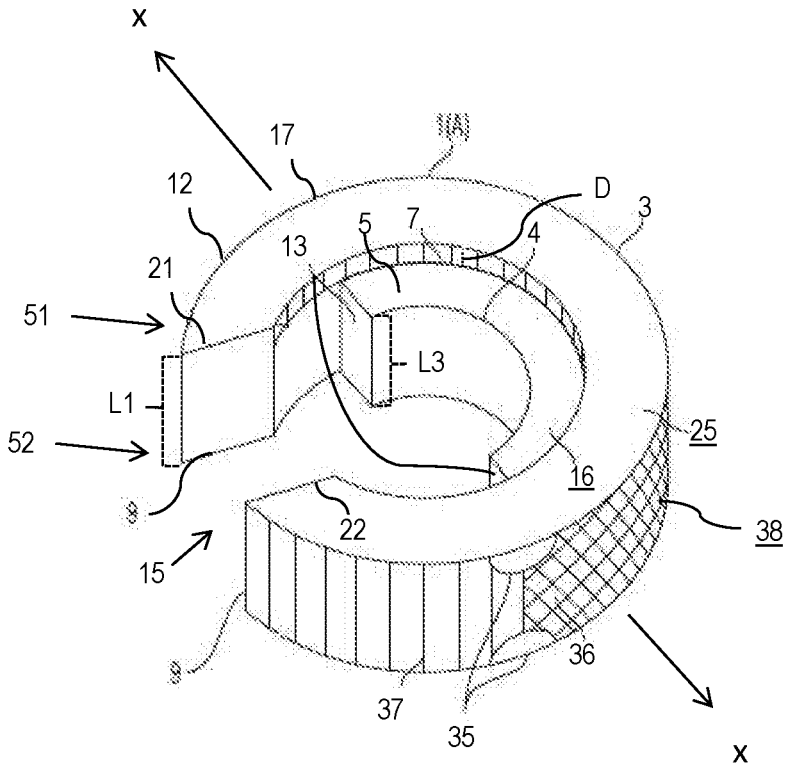
FIG. 7A is a perspective top elevated view schematic representation of the first interlocking part, according to an alternative embodiment.
Figure 7B:
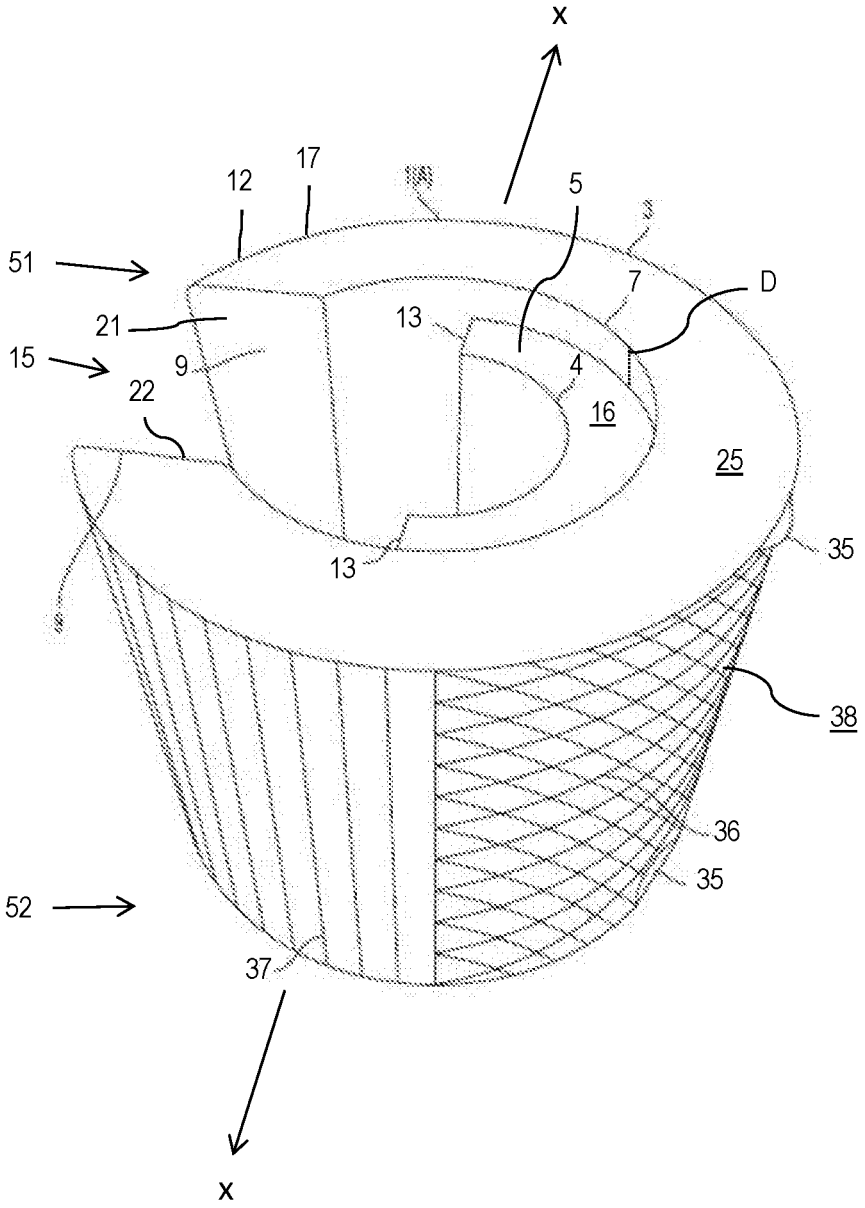
FIG. 7B is another perspective top elevated view schematic representation of the first interlocking part, according to an alternative embodiment.

Referring now to FIGS. 7A-7B, there are shown perspective top elevated views schematic representations of the first interlocking part 1(A) of the spacer apparatus 20, according to an embodiment. As described previously above and shown in the depicted embodiment, the first interlocking part 1(A) comprises a lock portion 12 and a countersunk area 5. The countersunk area 5 extends at depth D within the lock portion 12 of the body 17. In other words, the length L1 of the lock portion 12 is greater than a length L3 of the countersunk area 5 of the first interlocking part 1(A), as shown in FIG. 7A. In the depicted embodiment, the pair of countersunk ends 13 are substantially aligned or parallel with a central longitudinal axis x-x which extends through the center of the spacer apparatus 20. As also shown in FIGS. 5A-5B, the lock portion 12 has a pair of side end surfaces 9 on the first and second ends 21, 22. In one embodiment, shown in FIG. 4, the end surfaces 9 extend in a direction substantially perpendicular to the central longitudinal axis x-x extending through the center of the spacer apparatus 20. In an alternative embodiment, as shown in FIG. 5A, the end surfaces 9 extend at an angle slightly acute (FIG. 7A) or slightly obtuse (FIG. 7B) relative to the central longitudinal axis x-x extending through the center of the spacer apparatus 20. The first interlocking part 1(A) may also comprise optional finger grips 35 and knurling 36 with grooves 37 on an outer side surface 38 of the lock portion 12 to assist in the user's handling of the first interlocking part 1(A).

Figure 8A:
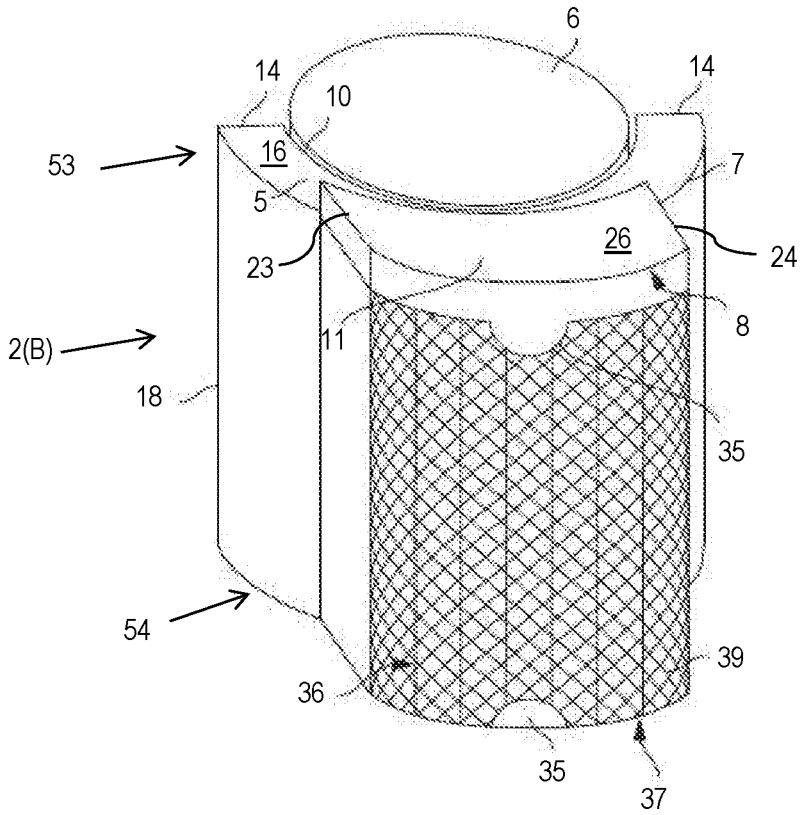
FIG. 8A is a perspective back elevated view schematic representation of the second interlocking part around an object, according to an embodiment.
Figure 8B:
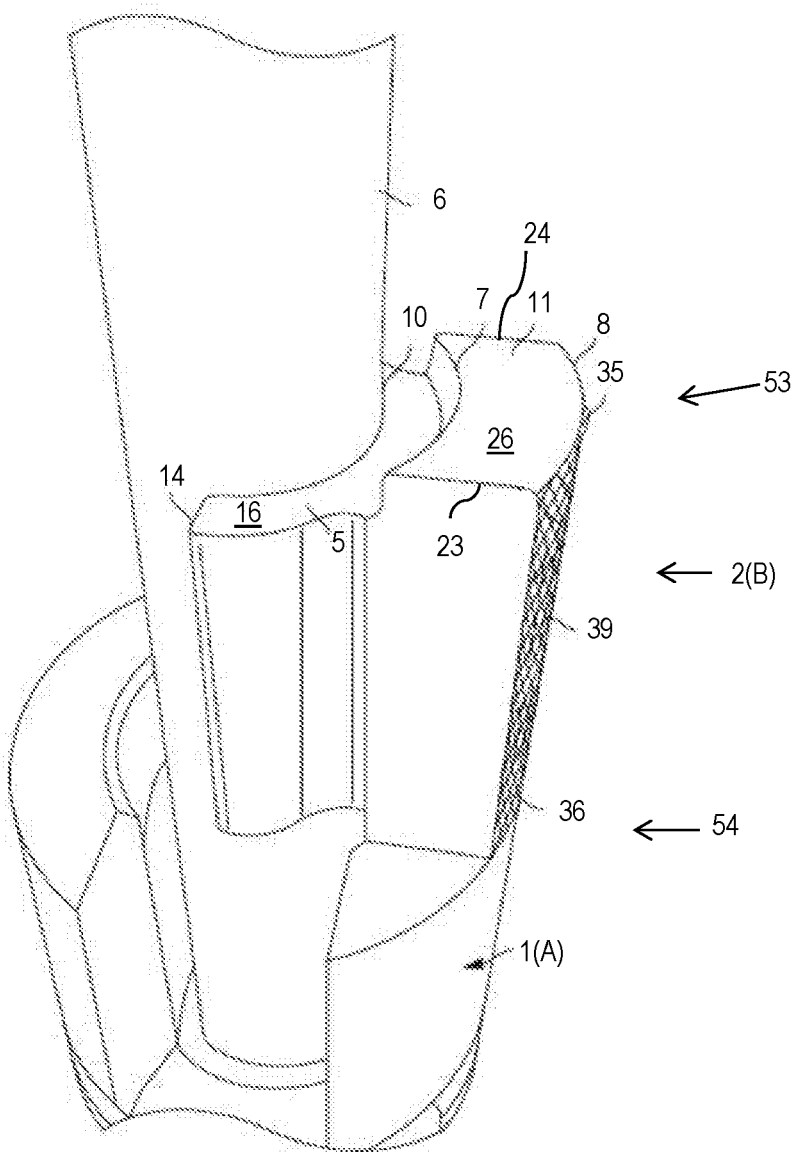
FIG. 8B is a perspective side elevated view schematic representation of the second interlocking part around an object, as it is set on top of the first interlocking part, according to an embodiment.

Turning now to FIGS. 8A-8B, there are shown perspective back and side views schematic representations of the second interlocking part 2(B) around an object 6. As shown in FIG. 8A, an object 6, such as a guide rod, fits within the inner perimeter 10 of the second interlocking part 2(B). As also shown in FIG. 8A, the top surface 16 of the countersunk area 5 is shown at depth D2 relative to (or within) the key portion 11 of the second interlocking part 2(B). In the depicted embodiment, the key portion 11 comprises knurling 36 on its outer side surface 39. Further, in the embodiment shown, the key portion 11 also includes one or more finger grips 35 at the top and bottom portions 53, 54. The embodiment shown in FIG. 8A also comprises grooves 37 on the outer side surface 39 of the key portion 11. Both the finger grips 35 and the grooves 37 assist a user in gripping the second interlocking part 2(B) (and spacer apparatus 20).

As shown in FIG. 8B, the spacer apparatus 20 is shown in the unlocked configuration on an object 6, such as a guide rod of a Smith Machine. In use, the first interlocking part 1(A) is placed around the guide rod 6 of a Smith Machine. The guide rod 6 is placed within the keyway 15 of the first interlocking part 1(A) such that the guide rod 6 abuts the inner perimeter 4 of the first interlocking part 1(A). The second interlocking part 2(B) is placed above the first interlocking part 1(A), abutting the first interlocking part 1(A). The second interlocking part 2(B) is placed around the guide rod 6 such that the inner perimeter 10 of the second interlocking part 2(B) abuts the guide rod 6. To achieve the interlocked configuration (in FIG. 3), the second interlocking part 2(B) is rotated above the first interlocking part 1(A) until its key portion 11 and the countersunk area 5 are aligned within the keyway 15 of the first interlocking part 1(A). The second interlocking part 2(B) is then unobstructed and able to slide within the keyway 15 of the first interlocking part 1(A).

Figure 9A:
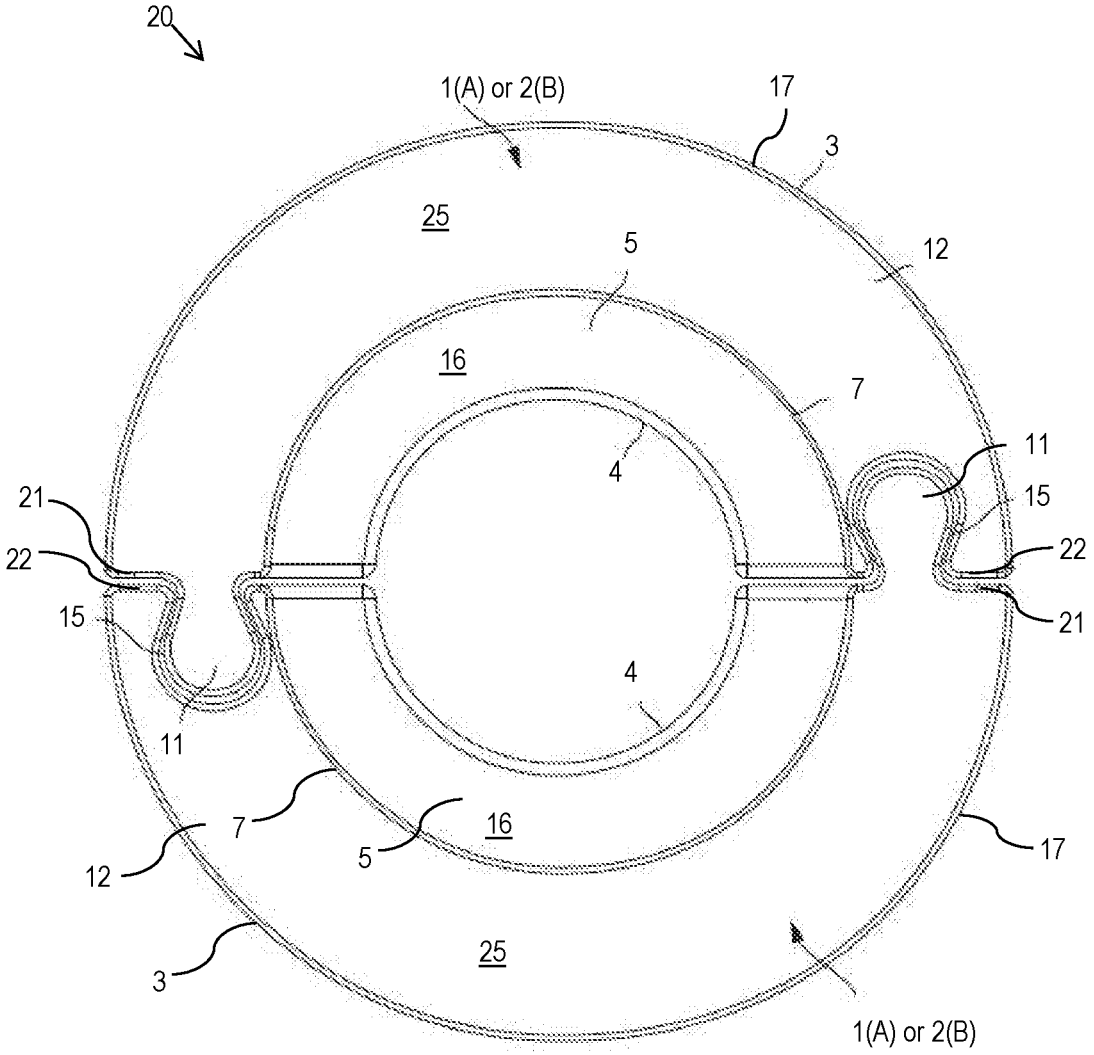
FIG. 9A is a top (and/or bottom) view schematic representation of the spacer apparatus, according to an alternative embodiment.
Figure 9B:
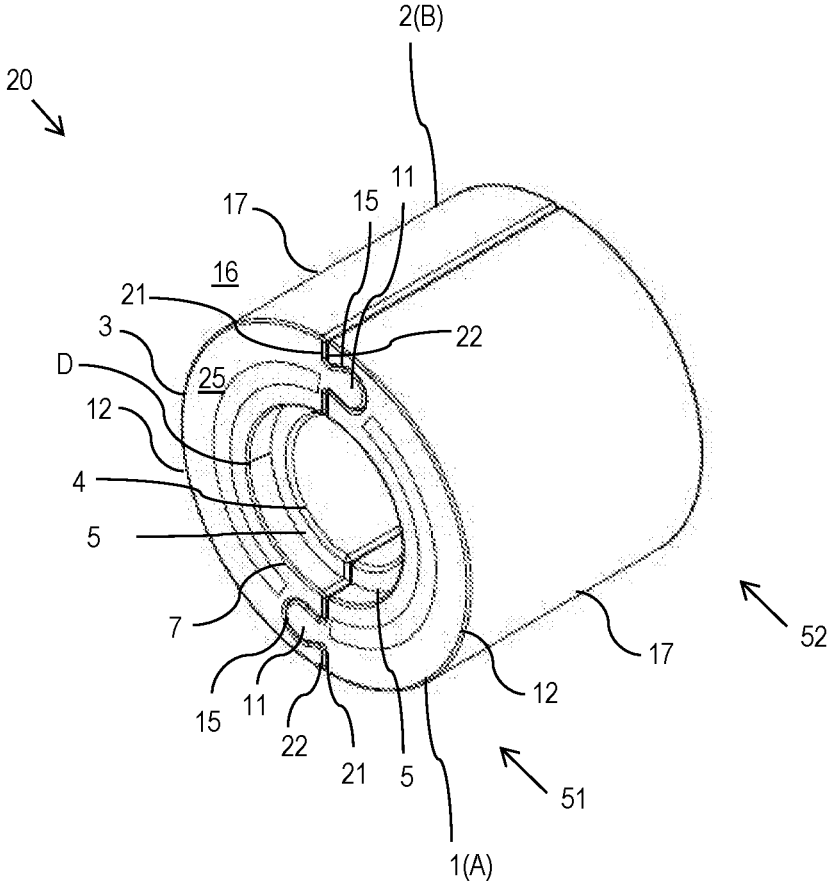
FIG. 9B is a perspective side angled view schematic representation of the spacer apparatus of FIG. 9A.

Referring now to FIG. 9A-9F, there are shown various views schematic representations of a spacer apparatus 20 and its components, according to an alternative embodiment. Turning first to FIG. 9A, there is shown a top (and/or bottom) view schematic representation of a spacer apparatus 20 in the interlocked configuration, according to an alternative embodiment. As shown, the spacer apparatus 20 comprises a first interlocking part 1(A) interlocked with a second interlocking part 2(B). The first and second interlocking parts 1(A), 2(B) are substantially similar, and in some embodiments, identical. The first and second interlocking parts 1(A), 2(B) comprise an outer perimeter 3, an outer countersunk perimeter 7, and an inner perimeter 4. The interlocking parts 1(A), 2(B) each have a countersunk area 5 between the inner perimeter 4 and the outer countersunk perimeter 7. The outer countersunk perimeter 7 is between the inner perimeter 4 and the outer perimeter 3. The lock portion 12 of the first and second interlocking parts 1(A), 2(B) has a top surface 25 between the outer countersunk perimeter 7 and the outer perimeter 3. A top surface 16 of the countersunk area 5 is at a depth D relative to the top surface 25 of the lock portion 12, as shown in FIG. 9B.

Figure 9C:
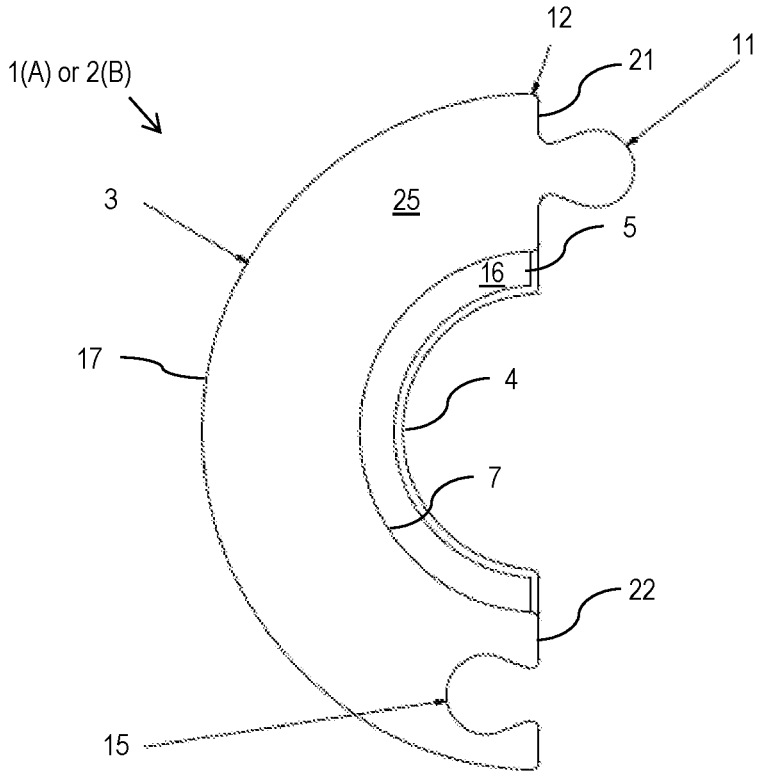
FIG. 9C is a top (and/or bottom) view schematic representation of a first or second interlocking part of the spacer apparatus of FIG. 9A.

Referring briefly to FIG. 9B, the interlocking parts 1(A), 2(B) both comprise male and female connections 11, 15 in the interlocked configuration. In the depicted embodiment, the first interlocking part 1(A) comprises a male connector 11 at a first end 21 of the lock portion 12 and a female groove 15 at a second end 22 of the lock portion 12. Similarly, the second interlocking part 2(B) comprises a female groove 15 at the first end 22 of the lock portion 12 and a male connector 11 at the second end 21 of the lock portion 12. However, interlocking parts 1(A), 2(B) may, alternatively, both be rotated 180 degrees to interlock. Thus, FIG. 9C shows either the configuration of both the first locking part 1(A) or the second interlocking part 2(B).

Figure 9D:
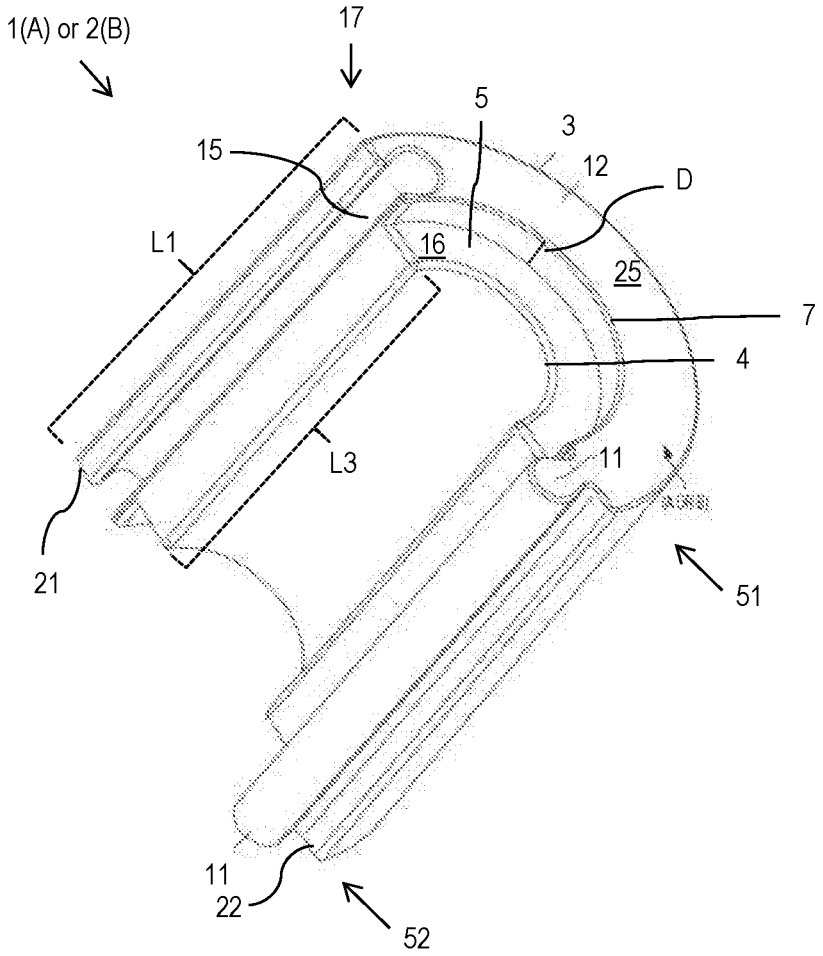
FIG. 9D is a perspective top angled view schematic representation of a first or second interlocking part of the spacer apparatus of FIG. 9A.
Figure 9E:
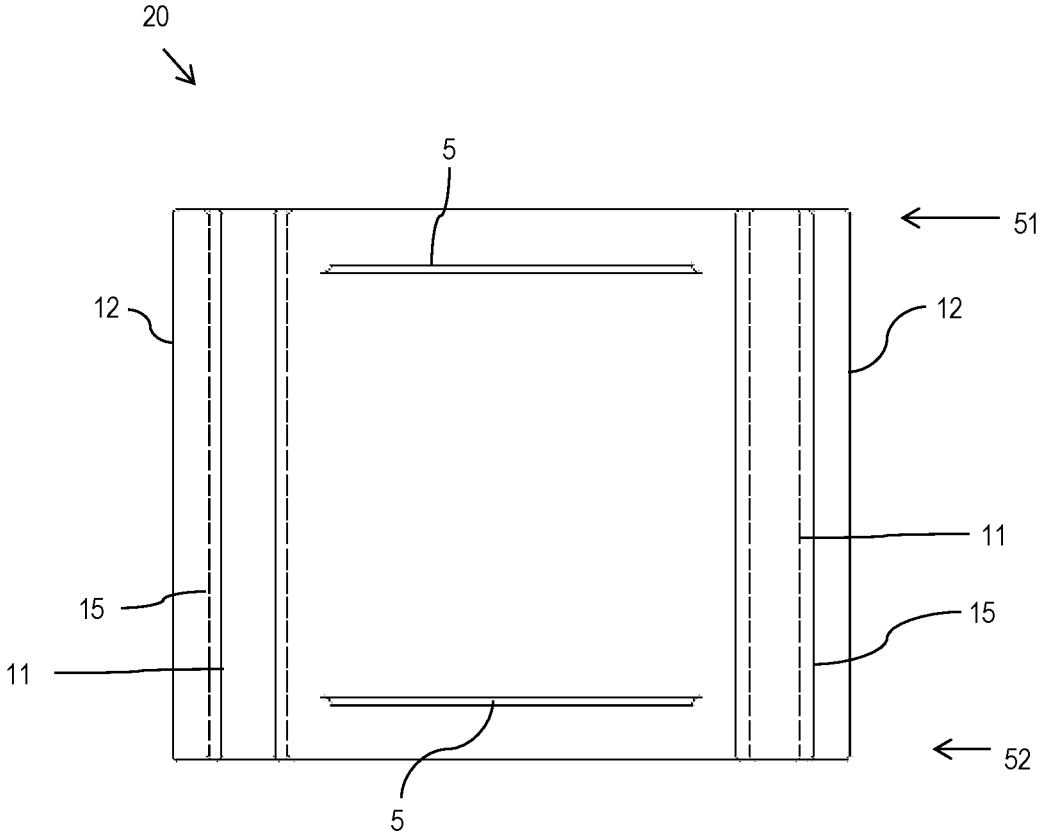
FIG. 9E is a front (and/or back) view schematic representation of a first and second interlocking parts, interlocked, of the spacer apparatus of FIG. 9A.

As shown in FIG. 9D, the male connector 11 and female groove 15 extend the entire length of the lock portion 12 from a top portion 51 of the body 17 to a bottom portion 52 of the body 17. FIG. 9E shows that countersunk area 5 has a length L3 which is shorter than a length L1 FIG. 9D of the lock portion 12. Further, FIG. 9D shows that the countersunk area 5 is at depth D relative to the top surface 25 of the lock portion 12 and the countersunk area 5 extends between, but not up to, the top portion 51 and the bottom portion 52 of the lock portion 12.

Figure 9F:
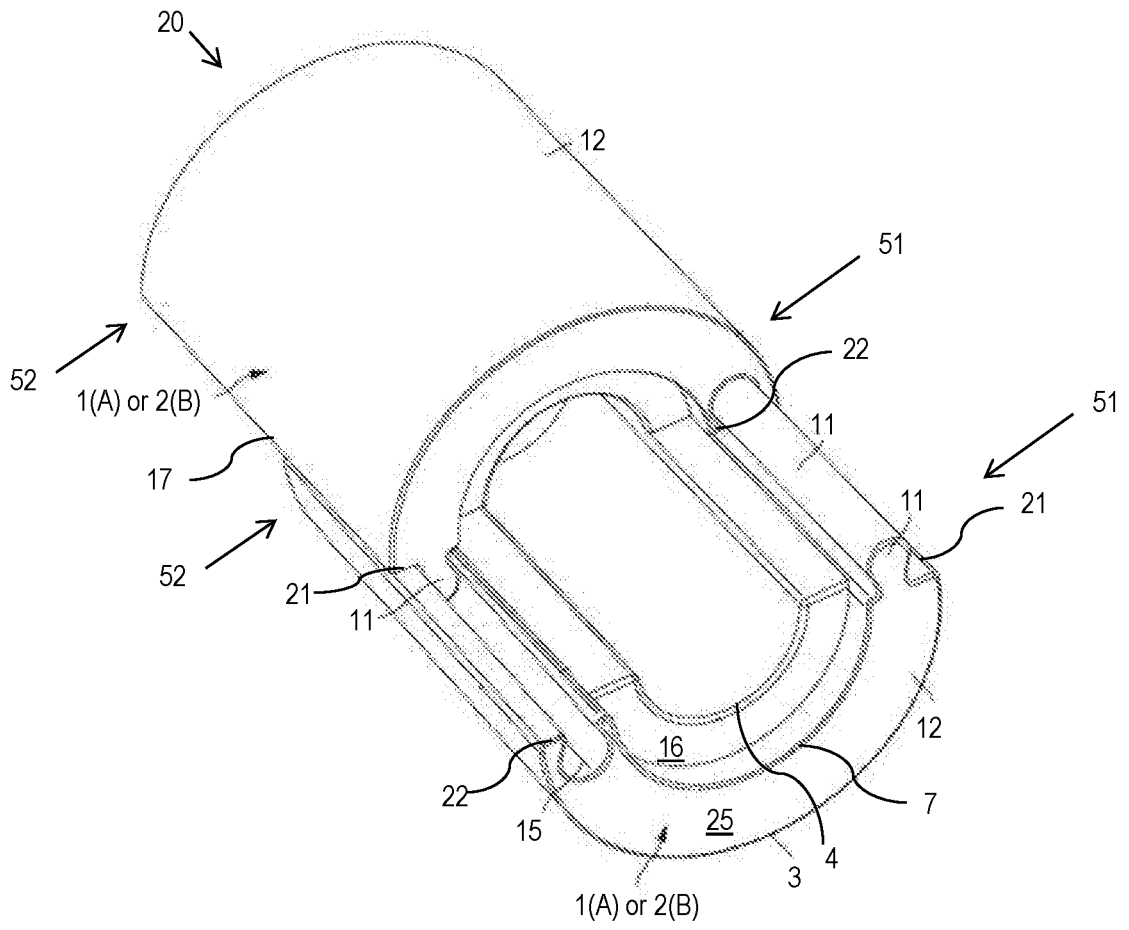
FIG. 9F is a perspective view schematic representation of a first interlocking part and a second interlocking part of the spacer apparatus of FIG. 9A moving from the unlocked to the interlocked configuration.

As shown in FIG. 9E, the male connector 11 of the first interlocking part 1(A) fits within or is otherwise interlocked within the female groove 15 of the second interlocking part 2(B) and the male connector 11 of the second interlocking part 2(B) fits within or is otherwise interlocked within the female groove 15 of the first interlocking part 1(A) in order to achieve the interlocked configuration (shown in FIG. 9B) of the spacer apparatus 20. The male connectors 11 slide within the female grooves 15 of the interlocking parts 1(A), 2(B), as shown in FIG. 9F to move the spacer apparatus from the unlocked configuration to the interlocked configuration.

Figure 10A:
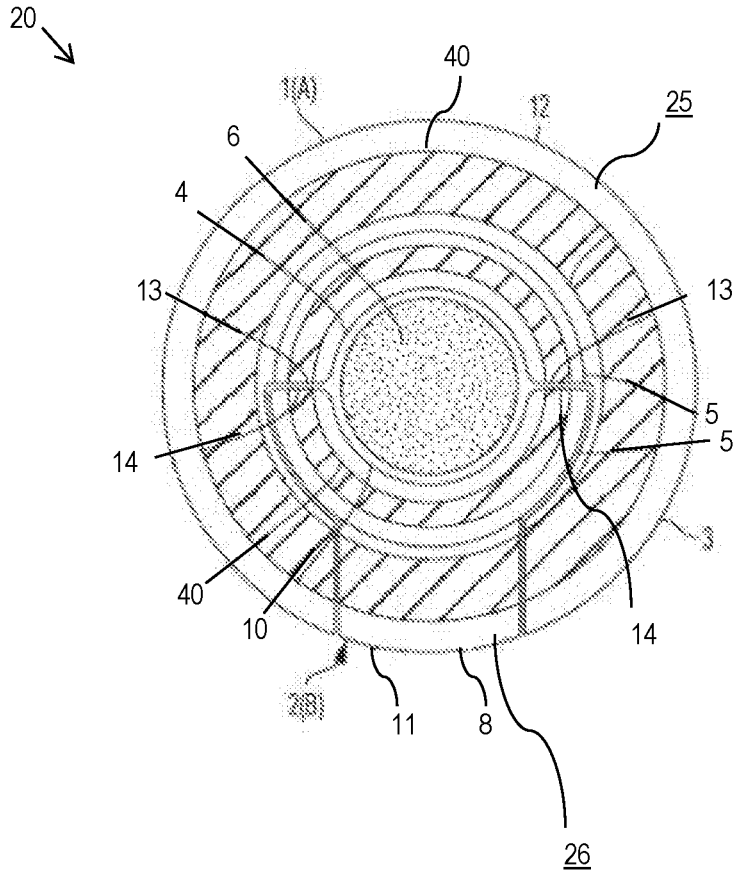
FIG. 10A is a top (and/or bottom) view schematic representation of the spacer apparatus of FIG. 3 with a cushion inlaid on its surfaces, in the interlocked configuration around an object, according to an embodiment.
Figure 10B:
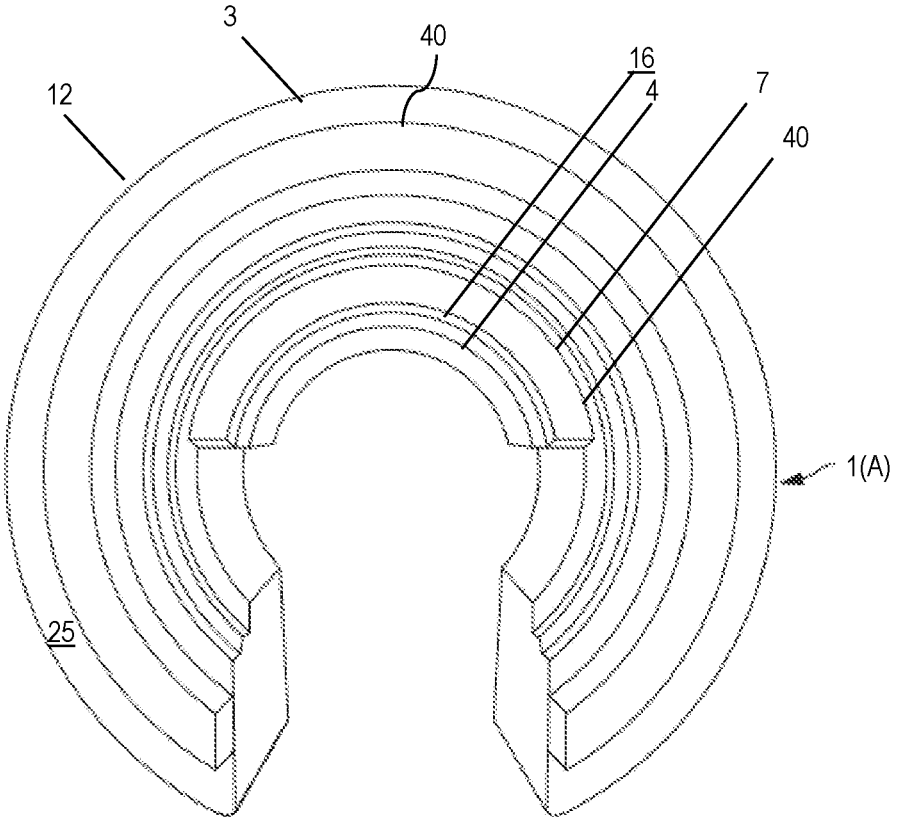
FIG. 10B is a perspective top (and/or bottom) view schematic representation of the first interlocking part with a cushion inlaid on its surfaces, according to an embodiment.
Figure 10C:
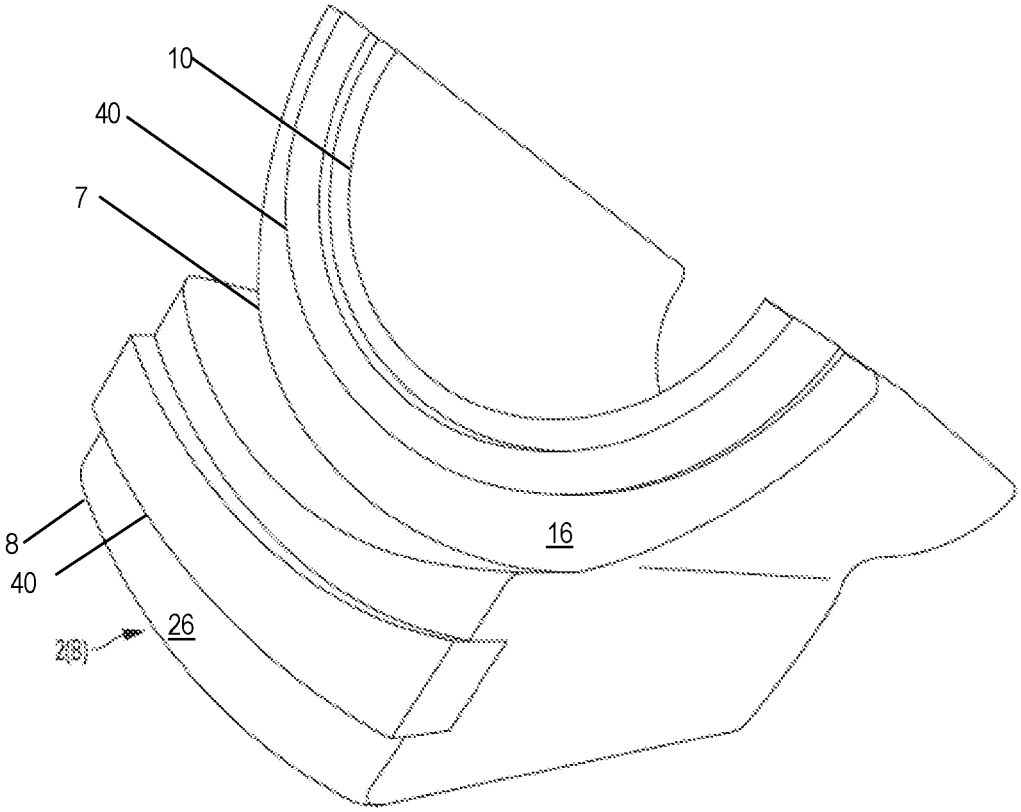
FIG. 10C is another perspective top view schematic representation of the second interlocking part with a cushion inlaid on its surfaces, according to an embodiment.

Referring now to FIG. 10A-10C there is shown various views schematic representations of the spacer apparatus 20 with a cushion 40 inlaid and on surfaces 25, 26, 16 of the interlocking parts 1(A), 2(B), according to an embodiment. In one embodiment, shown in FIG. 10A, the spacer apparatus 20 comprises a cushion 40. A cushion 40 may be a washer or other similar device of a fabric, rubber, or other similar flexible material. The cushion 40 is used to alleviate possible stress between the spacer apparatus 20 and the barbell guide rod sleeve (not shown). In the depicted embodiment, the cushion 40 is placed on the flat surfaces 25, 26, 16 of the spacer apparatus 20. In particular, the cushion 40 may be used on either, or both, a top surface 25, 26 (in FIG. 10A) and a bottom surface (not shown) of the lock portion 12, the key portion 11, and a top surface 16 of the countersunk areas 5. The cushion 40 may extend from the outer perimeters 3, 8 to the outer countersunk perimeter 7 of the first and second interlocking part 1(A), 2(B), respectively. The cushion 40 may also extend from the outer countersunk perimeter 7 to the inner perimeters 4, 10 of the first and second interlocking parts 1(A), 2(B), respectively. However, in some embodiments where the cushion 40 is used, the cushion 40 may only extend between or partially between adjacent perimeters and not up to and abutting each perimeter, as shown in FIG. 10A.

Figure 11:
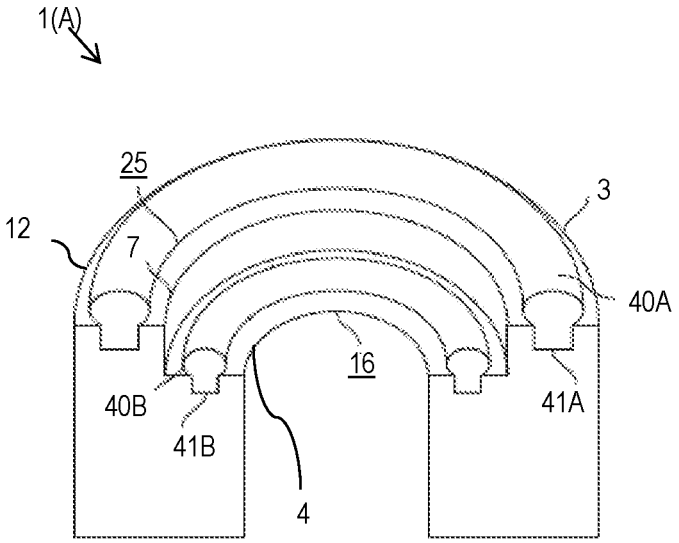
FIG. 11 is a perspective front cut-away view schematic representation of the first interlocking part with a cushion, according to an alternative embodiment.

Turning now to FIG. 11, there is shown perspective side cut-away view schematic representation of the first interlocking part 1(A) with a cushion 40A and or 40B, according to an alternative embodiment. While the cushion shown in the embodiment in FIGS. 10A-10C is laid or adhered to the top surfaces 25, 26, 16 (and/or bottom surfaces (not shown)) of the spacer apparatus 20, the cushion 40 in FIG. 11 is connected within a track 41 on the spacer apparatus 40. As shown in FIG. 11, a first track 41A extends along a top surface 25 of the lock portion 12 and a second track 41B extends along a top surface 16 of the countersunk area 5. A first cushion 40A is either fixed or slidably positioned within the first track 41A on the top surface 25 of the lock portion 12 and a second cushion 40B is either fixed or slidably positioned within the second track 41B of the top surface 16 of the countersunk area 5.

Figure 12:
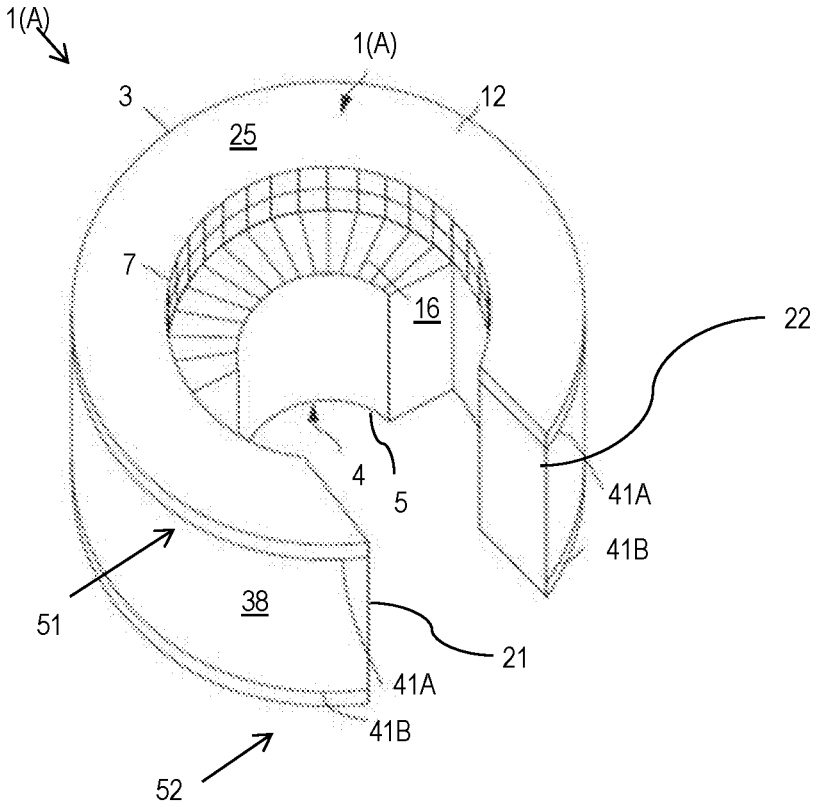
FIG. 12 a perspective top elevated view schematic representation of the cushion attachment locations on the first interlocking part, according to an alternative embodiment.
Figure 13:
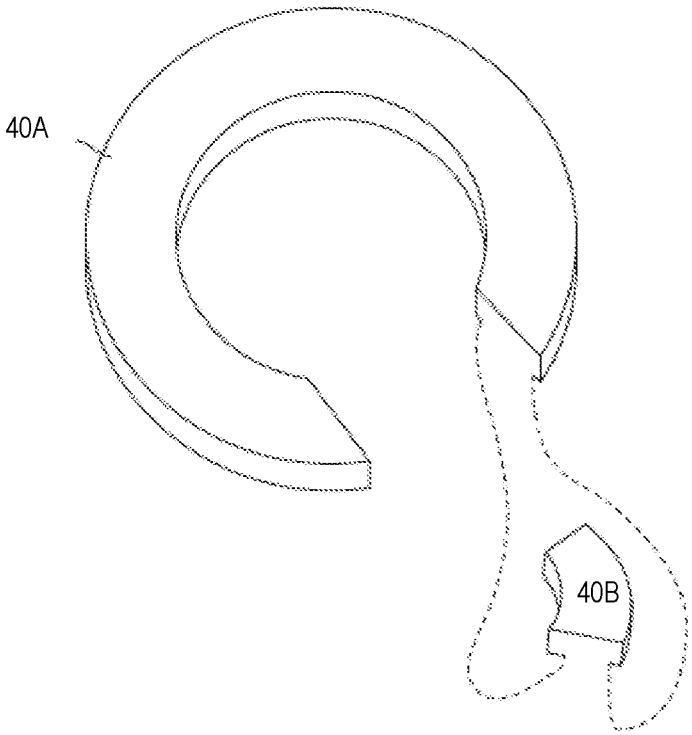
FIG. 13 is a perspective top view schematic representation of cushions for the first and second interlocking parts, according to an embodiment.

Referring now to FIG. 12, is a perspective elevated view schematic representation of the cushion attachment locations on the first interlocking part 1(A), according to an alternative embodiment. In the depicted embodiment, the first interlocking part 1(A) comprises a first continuous track 41A extending along the outer side surface 38 from the first end 21 to the second end 22 at the top portion 51 of the first interlocking part 1(A). In one embodiment, there may also be a second track 41B extending along the outer side surface 38 from the first end 21 to the second end 22 at the bottom portion 52 of the first interlocking part 1(A). The second interlocking part 2(B) (not shown) may also have similarly positioned tracks. A cushion 40A, such as a washer shown in FIG. 13, is placed within the tracks 41A (and/or 41B) in the outer side surface 38 (FIG. 12) along the first and second portions 51, 52 of the first interlocking part 1(A). Again, a cushion 40B (shown in FIG. 13) may also be inserted into the similarly positioned tracks of the second interlocking part 2(B). Due to the flexible nature of the cushions 40A, 40B, the cushions 40A, 40B may be installed by wrapping the cushions 40A, 40B around the outer side surfaces 38, 39 of the first and second interlocking parts 1(A), 2(B) and sliding the cushion 40A into the tracks 41A, 41B (and cushion 40B into the tracks of the second interlocking part 2(B) (not shown)).

Figure 14A:
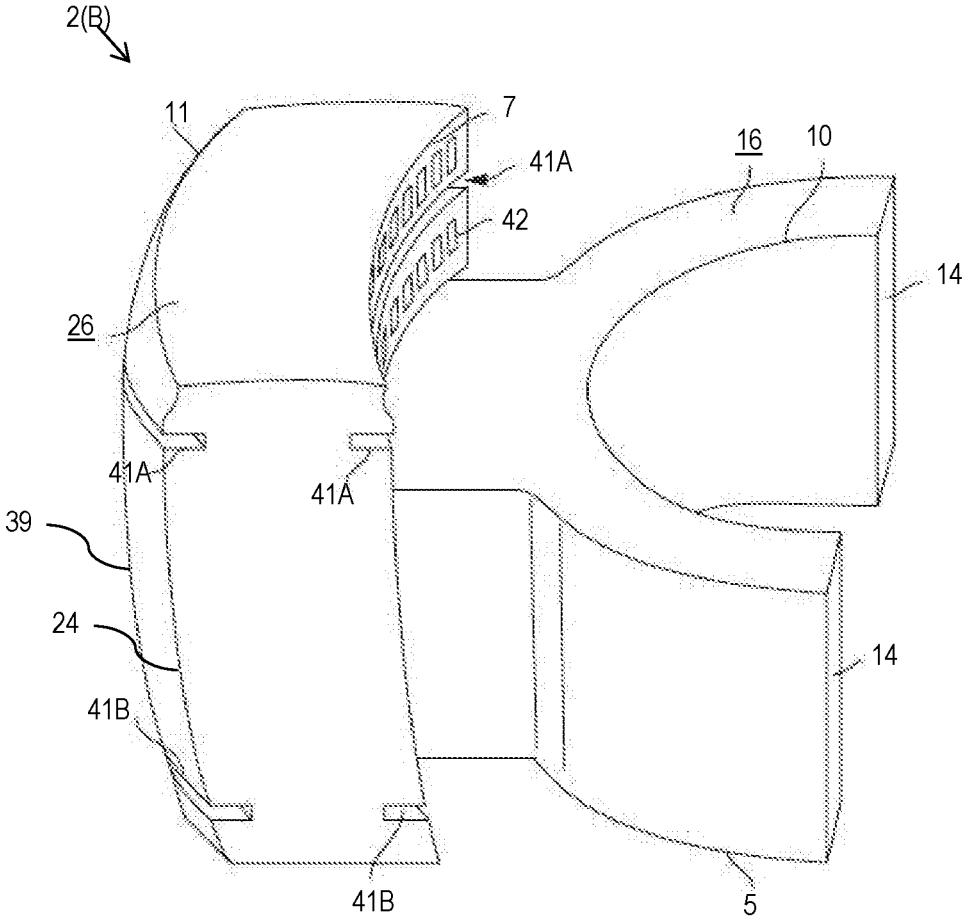
FIG. 14A is a perspective side elevated view schematic representation of the cushion attachment locations on the second interlocking parts, according to the embodiment.
Figure 14B:
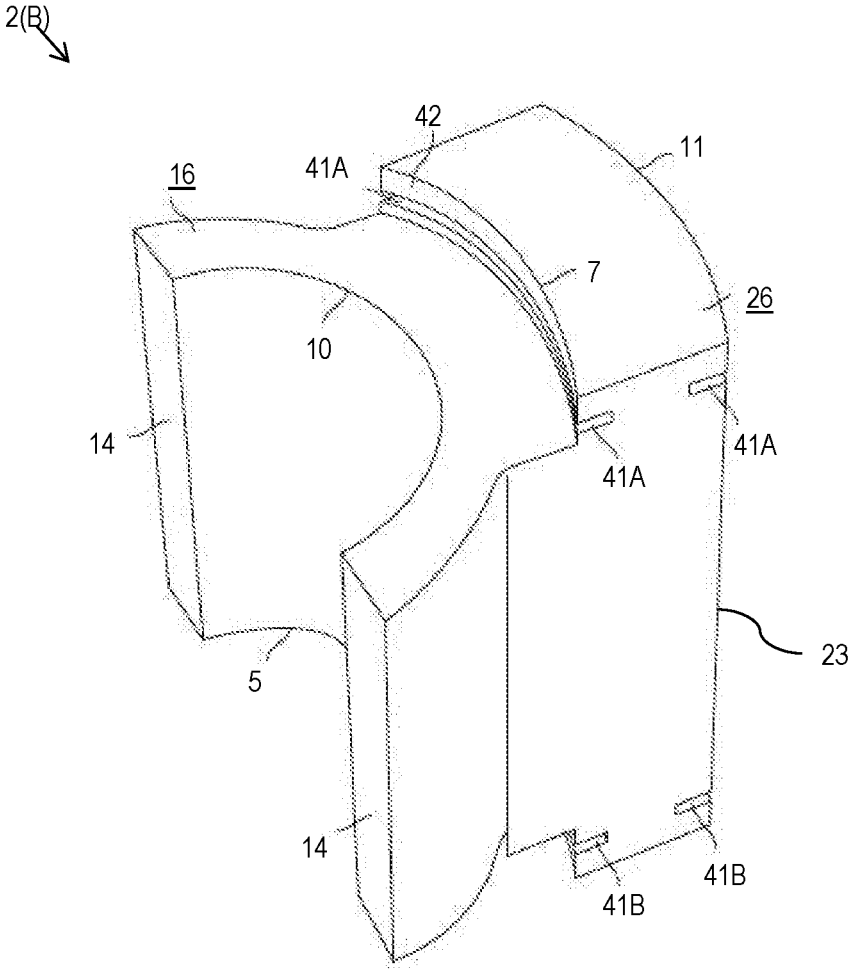
FIG. 14B is another perspective side elevated view schematic representation of the cushion attachment locations on the second interlocking parts, according to the embodiment.

Referring to FIGS. 14A-14B, there are shown perspective side views schematic representations of the cushion attachment locations on the second interlocking parts 2(B), according to the embodiment. The second interlocking part 2(B) comprises a first pair of tracks 41A and a second pair of tracks 41B. The first and second pair of tracks 41A, 41B extend through the key portion 11 of the body 18 second interlocking part 2(B). In the depicted embodiment, one of the first pair of tracks 41A and one of the second pair of the tracks 41B extend through the outer side surface 39 of the key portion 11. In addition, the other one of the first and second pair of tracks 41A, 41B extend through an inner surface 42 of the key portion 11 of the second interlocking part 2(B). In the depicted embodiment, the tracks of the first pair of tracks 41A are substantially aligned and the tracks of the second pair of tracks 41B are substantially aligned. However, the tracks in the first and second pairs of tracks 41A, 41B may not be aligned. A cushion 40 may be slidably moved or snapped into each of the tracks of the first and second pairs of tracks 41A, 41B.

Figure 15:
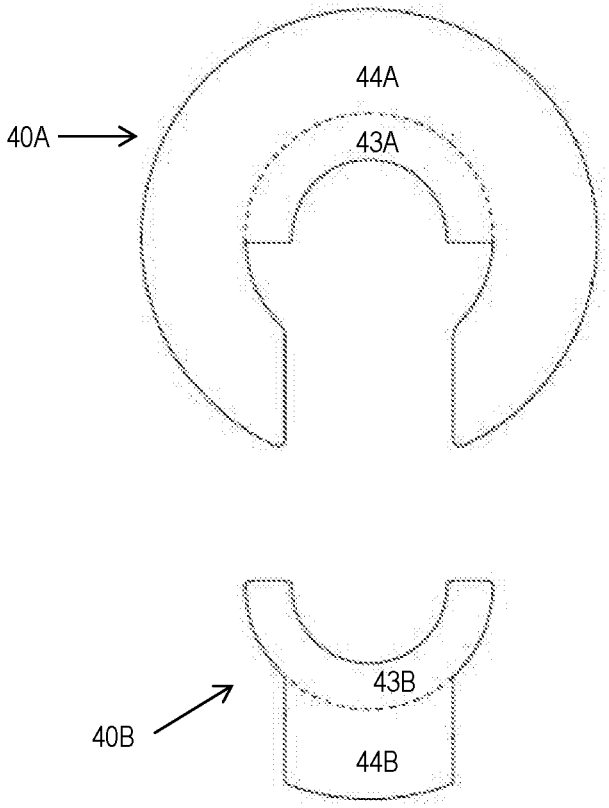
FIG. 15 is a top (and/or bottom) view schematic representation of a cushion for the spacer apparatus, according to an embodiment.
Figure 16:
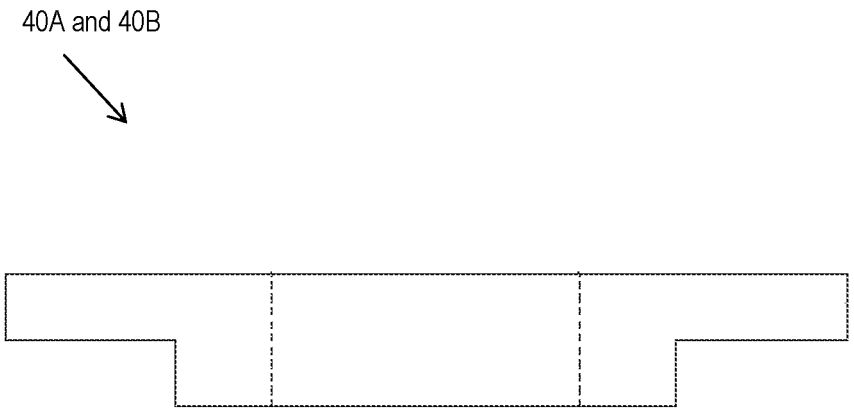
FIG. 16 is a side view schematic representation of the cushion of FIG. 15.

Turning now to FIGS. 15-16, there are shown various views schematic representations of a cushion 40 for the spacer apparatus 20, according to an embodiment. As shown in FIG. 15, the cushion 40 comprises a first cushion 40A for the first interlocking part 1(A) and a second cushion 40B for the second interlocking part 2(B). In the depicted embodiment, the first cushion 40A is shaped and otherwise corresponds to the top surfaces 25, 16 of the first interlocking part 1(A) and the second cushion 40B is shaped and otherwise corresponds to the top surfaces 26, 16 of the second interlocking part 2(B). The first and second cushions 40A, 40B are in a stepped configuration such that countersunk portions 43A, 43B of the first and second cushions 40A, 40B are at a depth relative to the lock and key portions 44A, 44B of the first and second cushions 40A, 40B as shown in FIG. 15. FIG. 16 is a side view of 40A and 40B in an interlocked configuration.

Figure 17:
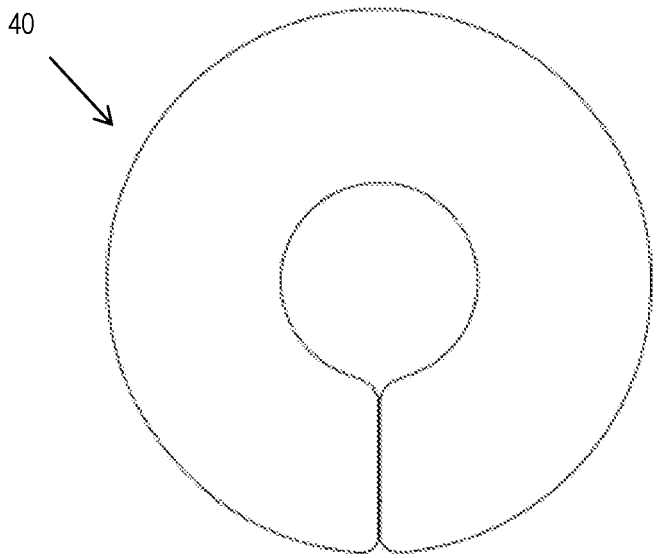
FIG. 17 is a top (and/or bottom) view schematic representation of a cushion for the spacer apparatus, according to an alternative embodiment.
Figure 18:
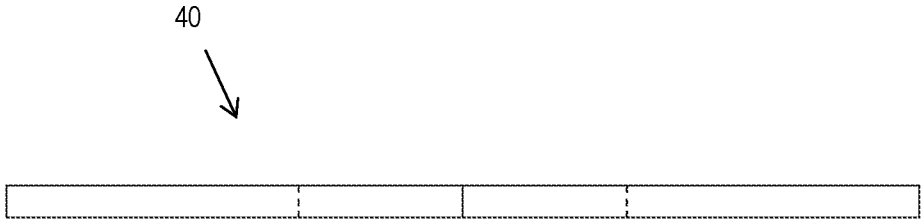
FIG. 18 is a side view schematic representation of the cushion of FIG. 17.

Referring now to FIGS. 17-18, there are shown various views of the cushion 40, according to an alternative embodiment. The first and second cushions 40A, 40B shown in FIGS. 15-16 are in a stepped configuration, while the cushion 40 shown in FIG. 17 is flat. In other words, the cushion 40 has only one depth, as shown in FIG. 18. Accordingly, the cushion 40, as described in the many embodiments above, may also be configured to correspond to the top surfaces 25, 16 of the embodiment of the spacer apparatus 20 as shown in FIG. 3 and as also shown in FIGS. 9A-9G, wherein the spacer apparatus 20 comprises male connectors 11 and female grooves 15.

Figure 19:
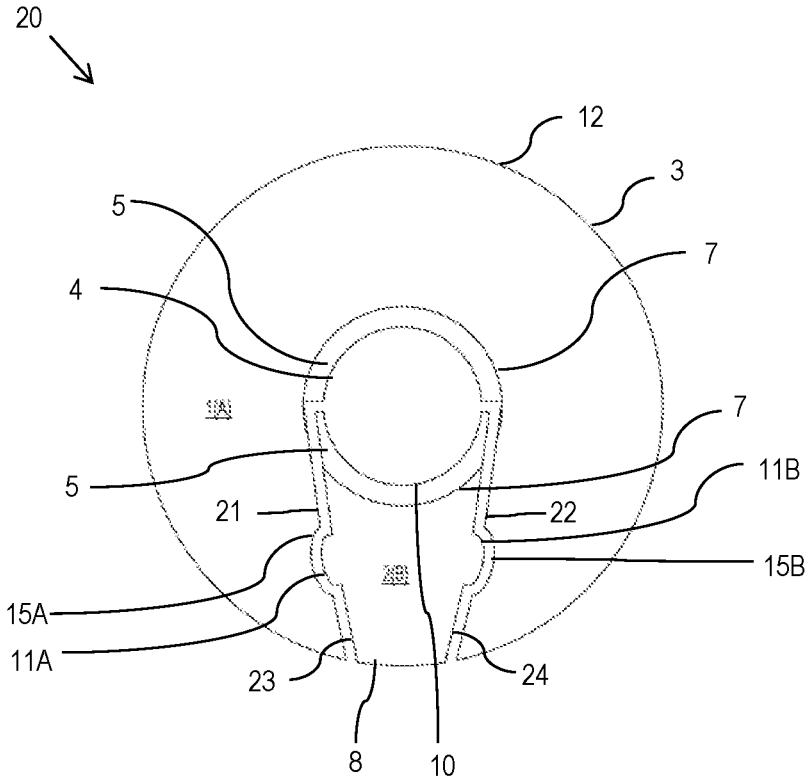
FIG. 19 is a top (and/or bottom) view schematic representation of spacer apparatus, according to an additional embodiment.

Turning now to FIG. 19, there is shown a top (and/or bottom) view schematic representation of spacer apparatus 20 according to an additional embodiment. As shown in FIG. 19, the second interlocking part 2(B) comprises a pair of male connectors 11 and the first interlocking part 1(A) comprises a corresponding pair of female grooves 15. However, in other embodiments, the first interlocking part 1(A) comprises the male connectors 11 and the second interlocking part 2(B) comprises the female grooves 15. As with the embodiment shown in FIGS. 9A-9F, the male connectors 11 and female grooves 15 extends the entire length of the first and second interlocking parts 1(A), 2(B). Further, as described in detail above with regard to the other embodiments of the spacer apparatus 20, the second interlocking part 2(B) slides within the first interlocking part 1(A) to achieve a interlocked configuration. In the depicted embodiment, the second interlocking part 2(B) comprises the pair of male connectors 11A, 11B on opposing first and second ends 23, 24 of the second interlocking part 2(B). A first male connector 11A is on the first end 23 of the second interlocking part 2(B) and the second male connector 11B is on the second end 24 of the second interlocking part 2(B). The first and second ends 23, 24 of the second interlocking part 2(B) are tapered and are otherwise generally angled toward each other, as if from an external angle, as shown in FIG. 19. As such, the first interlocking part 1(A) comprises a pair of female grooves 15A, 15B on corresponding opposing first and second ends 21, 22 of the first interlocking part 1(A). The opposing first and second ends 21, 22 of the first interlocking part 1(A) are also tapered, as if from an external angle, as shown in FIG. 19.

Figure 20:
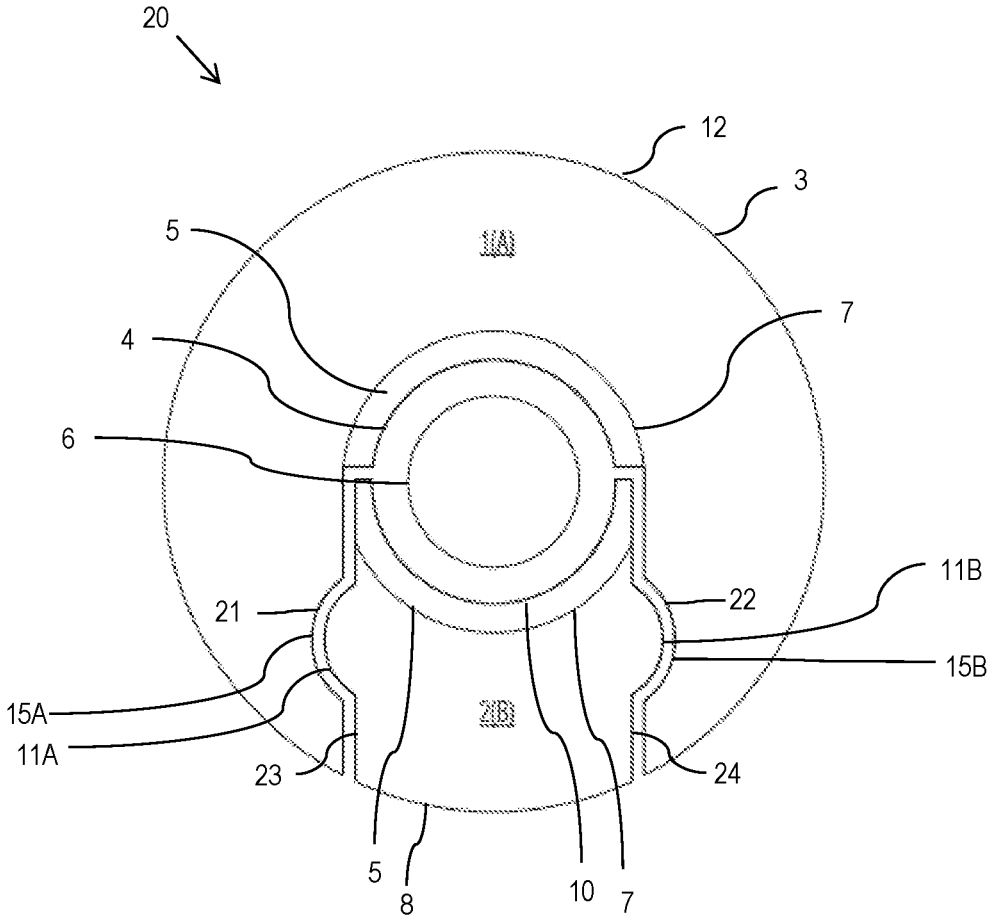
FIG. 20 is a top (and/or bottom) view schematic representation of spacer apparatus according to another embodiment

Referring now to FIG. 20, there is shown a top (and/or bottom) view schematic representation of the spacer apparatus 20, according to another embodiment. As shown in FIG. 20, the second interlocking part 2(B) comprises a pair of male connectors 11 and the first interlocking part 1(A) comprises a corresponding pair of female grooves 15. However, in other embodiments, the first interlocking part 1(A) comprises the male connectors 11 and the second interlocking part 2(B) comprises the female grooves 15. As described in detail above with regard to the other embodiments of the spacer apparatus 20, the second interlocking part 2(B) slides within the first interlocking part 1(A) to achieve a interlocked configuration. In the depicted embodiment, the second interlocking part 2(B) comprises the pair of male connectors 11A, 11B on opposing first and second ends 23, 24 of the second interlocking part 2(B). A first male connector 11A is on the first end 23 of the second interlocking part 2(B) and the second male connector 11B is on the second end 24 of the second interlocking part 2(B). The first and second ends 23, 24 of the second interlocking part 2(B) are substantially parallel (with the exception of the male connectors 11A, 11B). As such, the first interlocking part 1(A) comprises a pair of female grooves 15A, 15B on corresponding opposing first and second ends 21, 22 of the first interlocking part 1(A). The opposing first and second ends 21, 22 of the first interlocking part 1(A) are also substantially parallel (with the exception of the female grooves 15A, 15B), as shown in FIG. 20.

Figure 25:
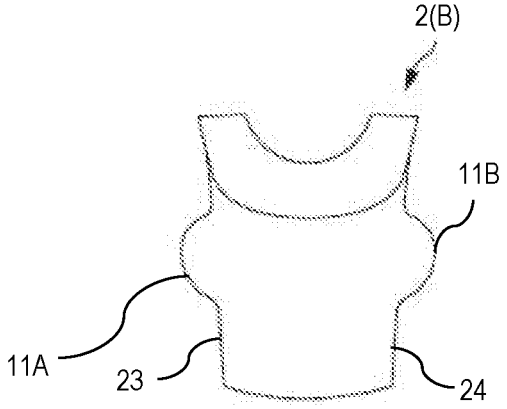
FIG. 25 is a perspective top (and/or bottom) view schematic representation of the second interlocking part of FIG. 19.
Figure 26:
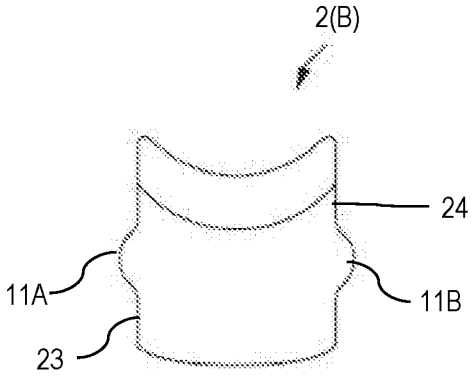
FIG. 26 is a perspective top (and/or bottom) view schematic representation of the second interlocking part of FIG. 20.
Figure 27:
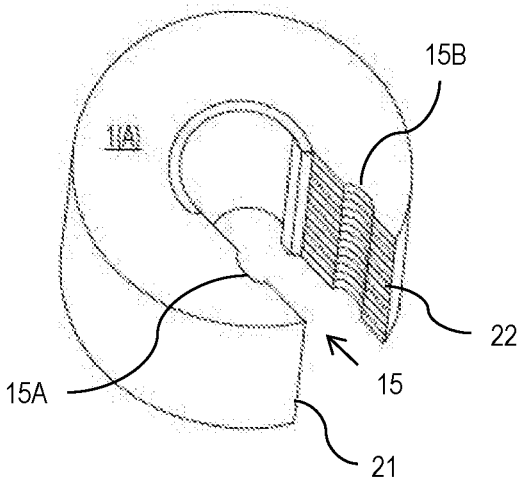
FIG. 27 is a perspective elevated side view schematic representation of the first interlocking part of FIG. 20.

Turning now to FIGS. 25-27, there are shown various views of a spacer apparatus 20 according to the embodiments shown in FIGS. 19-20. In the depicted embodiment, the spacer apparatus 20 utilizes a general top entry to achieve the lock configuration. FIGS. 25-26 show top (and/or bottom) views of the second interlocking part 2(B) of the spacer apparatus 20. In the depicted embodiment, the second interlocking part 2(B) comprises a pair of male connectors 11A, 11B extending from opposing first and second ends 23, 24 of the second interlocking part 2(B). The opposing first and second ends 23, 24 of the second interlocking part 2(B) in FIG. 25 are tapered or otherwise angled toward each other (with the exception of the male connectors 11A, 11B), as also shown in FIG. 19. The opposing first and second ends 23, 24 of the second interlocking part 2(B) in FIG. 26 are substantially parallel (with the exception of the male connectors 11A, 11B), as also shown in FIG. 20. FIG. 27 shows a perspective top view of the first interlocking part 1(A) of the top entry embodiment. The second interlocking part 2(B) of FIG. 26 can be interlocked within the first interlocking part 1(A) of FIG. 27 by sliding the second interlocking part 2(B) into the keyway 15 of the first interlocking part 1(A). A first interlocking part 1(A) with angled or tapered first and second ends 21, 22, as shown in FIG. 19, can be similarly interlocked with the second interlocking part 2(B) of FIG. 25.

Figure 21:
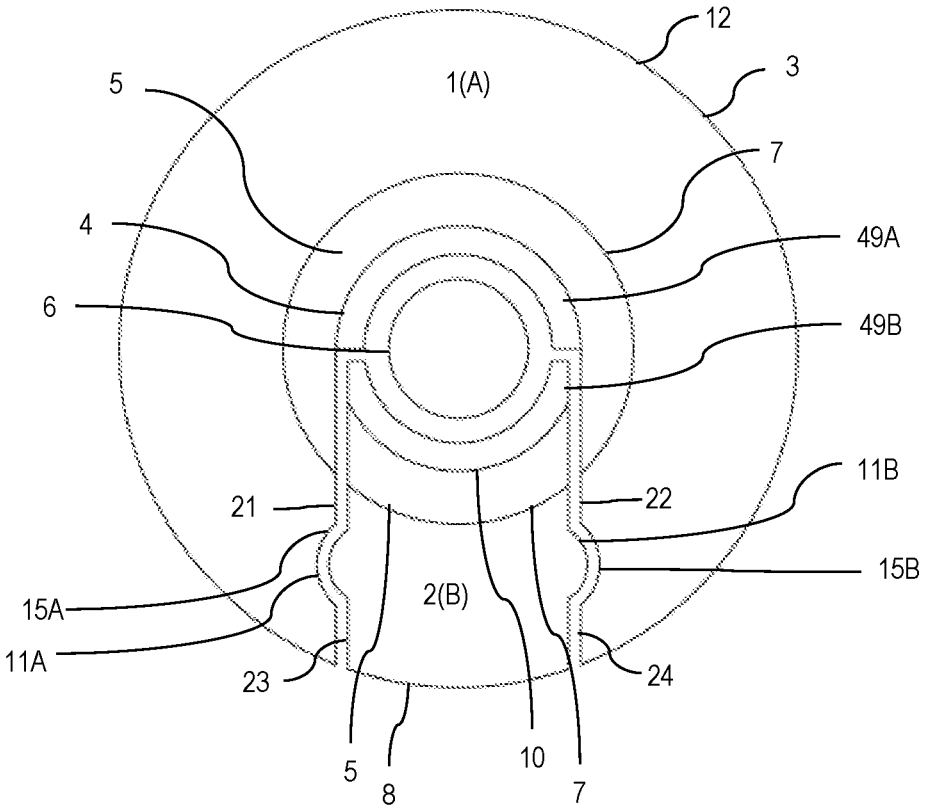
FIG. 21 is a top (and/or bottom) view schematic representation of a bushing accessory applied to the spacer apparatus, according to an embodiment.
Figure 22:
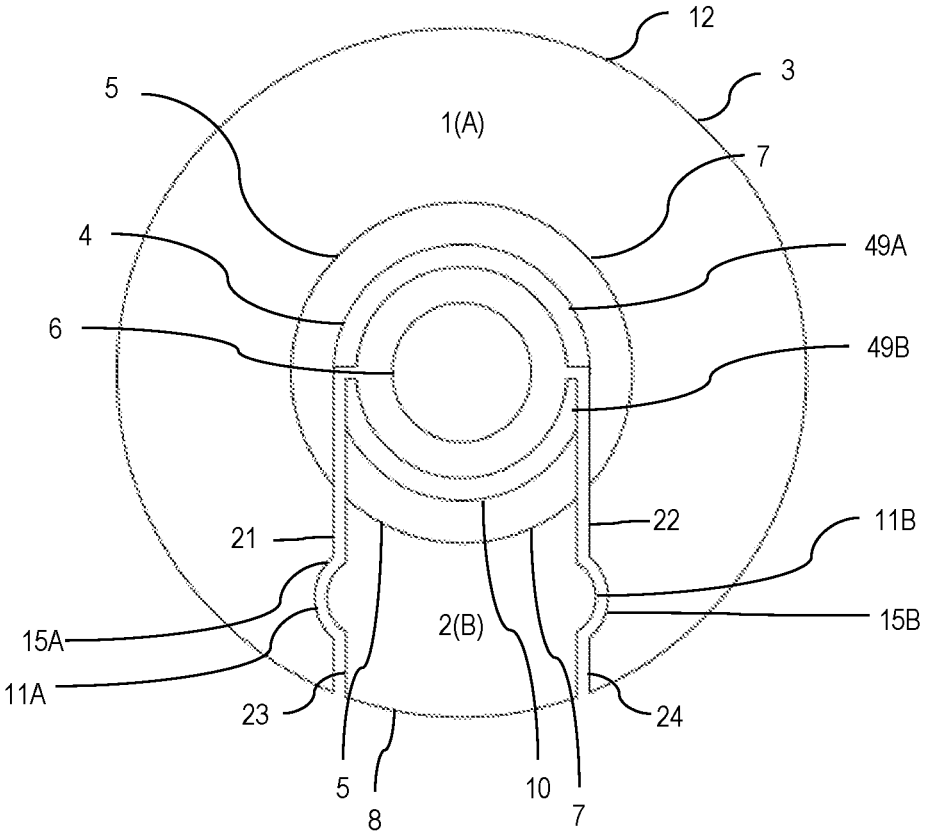
FIG. 22 is a top (and/or bottom) view schematic representation of a bushing accessory applied to the spacer apparatus, according to an additional embodiment.
Figure 24:
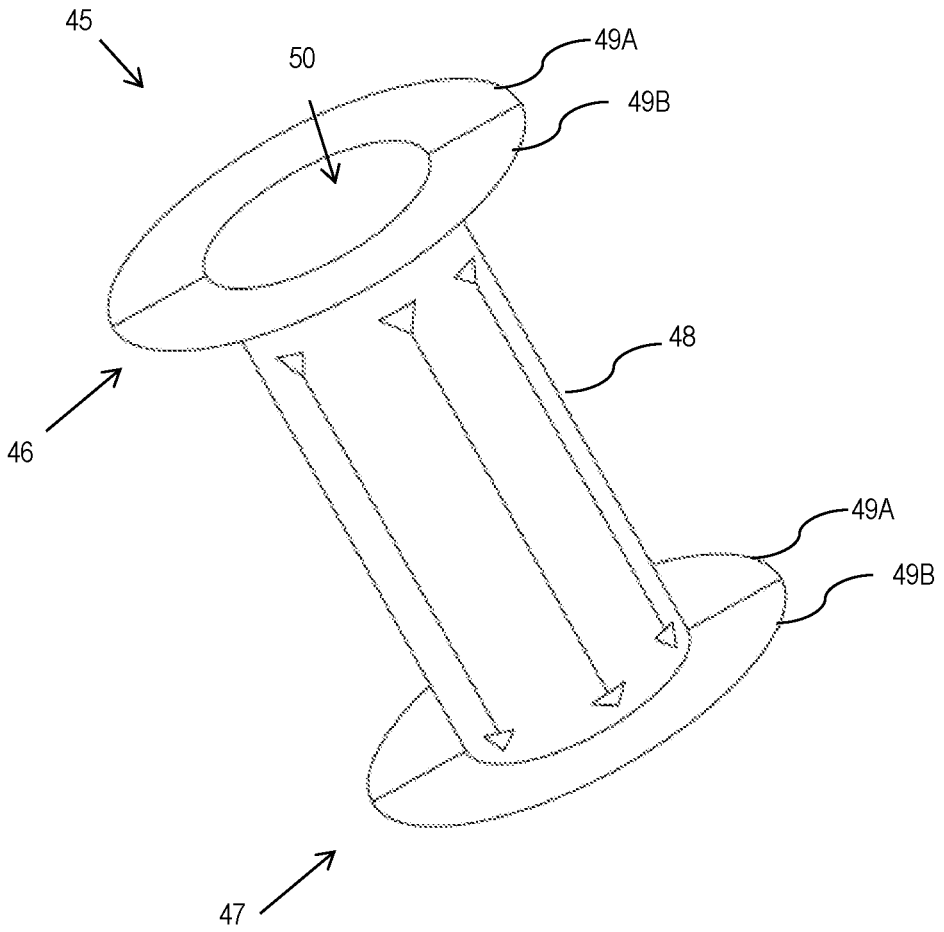
FIG. 24 is a perspective side angled view schematic representation of a bushing accessory, according to an embodiment.

Turning now to FIG. 21-22, there are shown top (and/or bottom) views schematic representations of a bushing accessory 45 applied to the spacer apparatus 20. As shown in FIGS. 21-22, the bushing accessory 45 abuts or is fixed to the inner perimeters 4, 10 of the interlocking parts 1(A), 2(B), respectively. An exemplary embodiment of the bushing accessory 45 is shown in FIG. 24. The bushing accessory 45 has a flat top portion 46 and flat bottom portion 47 with a length of material 48 extending therebetween. The flat top portion 45, flat bottom portion 47, and length of material 48 comprise a first portion 49A and a corresponding second portion 49B. When the first portion 49A abuts the second portion 49B, the flat top portion 45, flat bottom portion 47, and the length of material 48 form an enclosed channel 50 in the interlocked configuration, as shown in FIG. 24.

Figure 23:
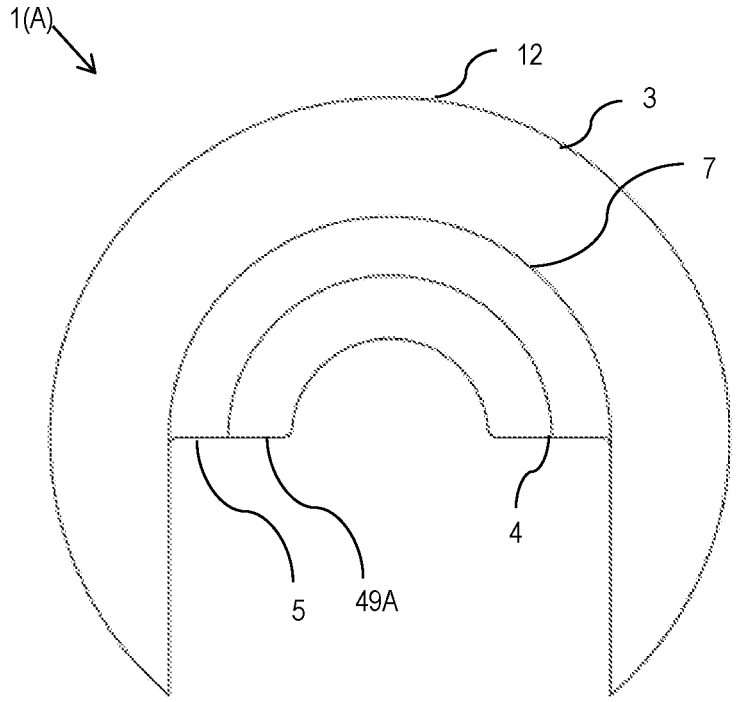
FIG. 23 is a top (and/or bottom) view schematic representation of a bushing accessory applied to the first interlocking part, according to an embodiment.

In use, the first portion 49A of the bushing accessory 45 is placed along the inner perimeter 4 of the first interlocking part 1(A), as shown in FIG. 23. Similarly, the second portion 49B of the bushing accessory 45 is placed along the inner perimeter 10 of the second interlocking part 2(B) (not shown). In use, the first and second portions 49A, 49B of the bushing accessory 45 surrounds an object 6, such as a guide rod of the Smith Machine, as shown in FIGS. 21-22.

Figure 28:
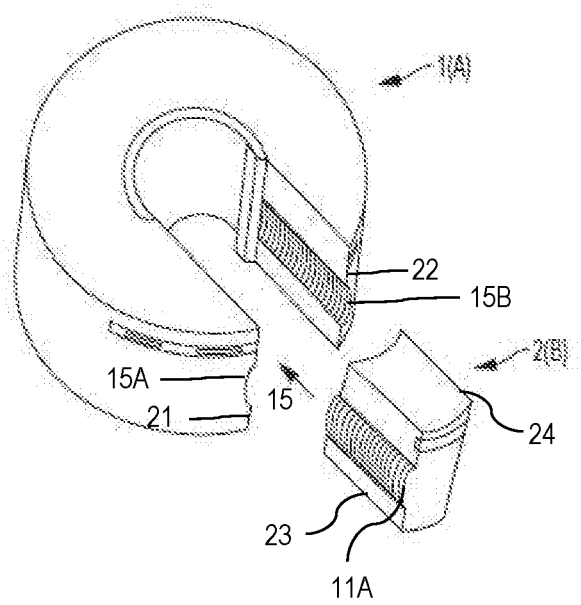
FIG. 28 is a perspective elevated side view schematic representation of the spacer apparatus of a side entry embodiment.

Turning now to FIG. 28, there is shown a perspective top angled view of the spacer apparatus 20 of a side entry embodiment. In the depicted embodiment, the second interlocking part 2(B) comprises a pair of male connectors 11A, 11B (not shown because of angle) extending from the opposing first and second ends 23, 24 of the second interlocking part 2(B) and the first interlocking part 1(A) comprises a pair of female grooves 15A, 15B extending into the opposing first and second ends 21, 22 of the first interlocking part 1(A). The second interlocking part 2(B) is interlocked within the first interlocking part 1(A) by sliding the second interlocking part 2(B) into the keyway 15 of the first interlocking part 1(A).

Figure 29:
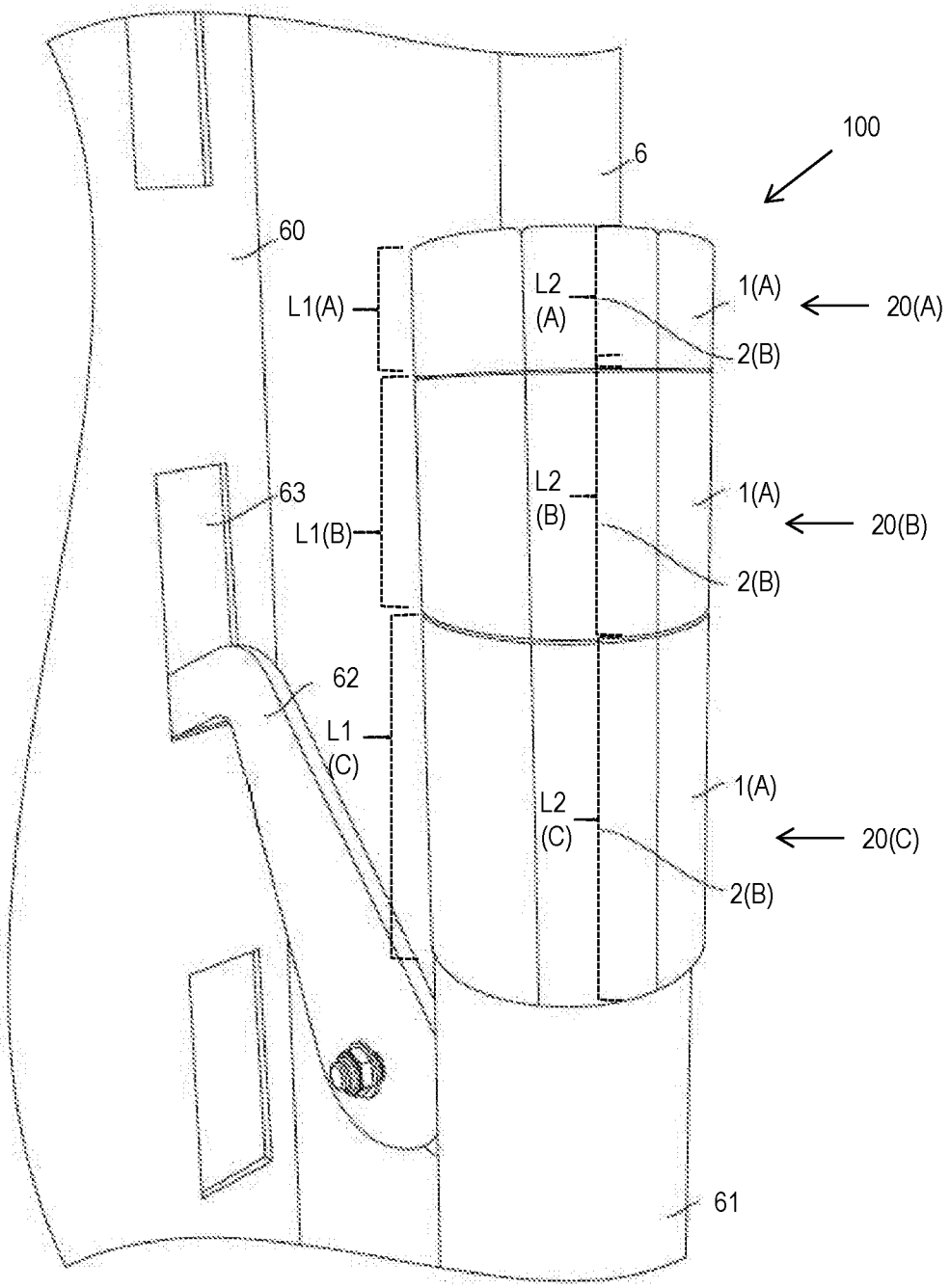
FIG. 29 is a perspective side view schematic representation of the spacer system around one guide rod on top of a safety stop on a Smith Machine, according to an embodiment.

Referring now to FIGS. 29-32, there are shown various views schematic representations of the spacer system 100 as in use on one side and around one guide rod 6 of a Smith Machine 60. As shown in FIG. 29, the first, second, and third spacer apparatuses 20A, 20B, 20C of the spacer system 100 are in the interlocked configuration around a guide rod 6 of the Smith Machine 60 on top of a safety stop sleeve 61. The Smith Machine 60 in the depicted embodiment comprises the safety stop sleeve 61 and a hook 62 latched into a slot 63 on a frame member 64 of the Smith Machine 60.

In the depicted embodiment, the first spacer apparatus 20A has a first height (the larger of L1(A) and L2(A)), the second spacer apparatus 20B has a second height (the larger of L1(B) and L2(B)), and the third spacer apparatus 20C has a third height (the larger of L1(C) and L2(C)). In the depicted embodiment, the size of the spacer apparatuses 20A, 20B, 20C are relative to the heights as follows: L1(A)<L1(B)<L1(C) and L2(A)<L2(B)<L2(C). In the depicted embodiment, L1(A)=L2(A), L1(B)=L2(B), and L1(C)=L2(C). For example, L1(A)=L2(A)=1 in., L1(B)=L2(B)=2 in., and L1(C)=L2(C)=3 in. Thus, the user can selectively use the spacer apparatuses 20A, 20B, 20C to increase (or decrease) the height of the spacer system 100 at 1 in., 2 in., 3 in., 4 in., 5 in., and 6 in. increments. Therefore, a barbell on a guide rod 6, for example, can come to rest at 1-inch increments within the range of 1-6 inches when the spacer apparatuses 20A, 20B, 20C are used individually or in combination. However, in another example, the user may interchange a second interlocking part 2(B) of first spacer apparatus 20(A) with a second interlocking part 2(B) of the second spacer apparatus 20(B) such that the first interlocking part 1(A) of the first spacer apparatus 20(A) interlocks with the second interlocking part 2(B) of the second spacer apparatus 20(B). Then, in order to evenly stack the first spacer apparatus 20(A) and the second spacer apparatus 20(B), the user may also interlock the second interlocking part 2(B) of the first spacer apparatus 20(A) with the first interlocking part 1(A) of the second spacer apparatus 20(B). Thus, the interlocking parts 1(A), 2(B) of the three spacer apparatuses 20A, 20B, 20C can be interchanged and still form an evenly stacked spacer system 100. The user may also utilize any single or combination of the spacer apparatuses 20A, 20B, 20C, such that one, any two, or all three spacer apparatus 20A, 20B, 20C are simultaneously utilized.

Figure 30:
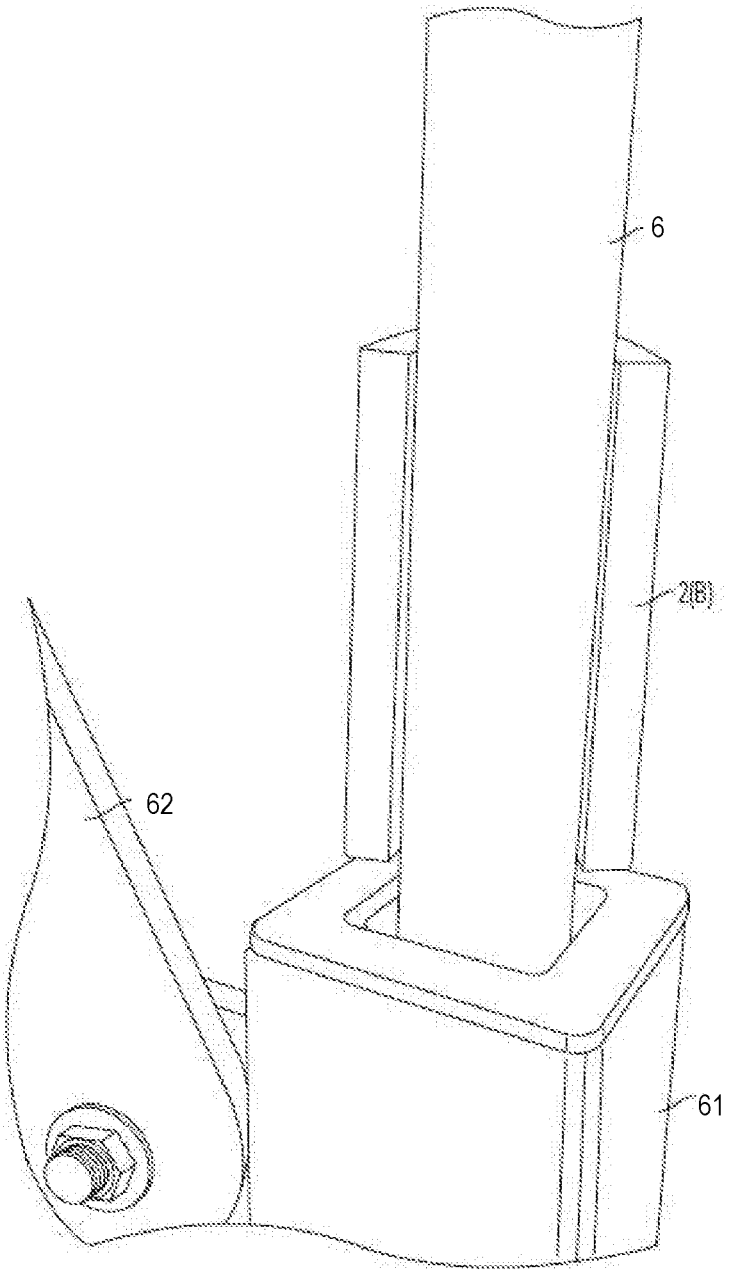
FIG. 30 is a perspective side elevated view schematic representation of the second interlocking part on top of a safety stop up against a guide rod of a Smith Machine, according to an embodiment.
Figure 31:
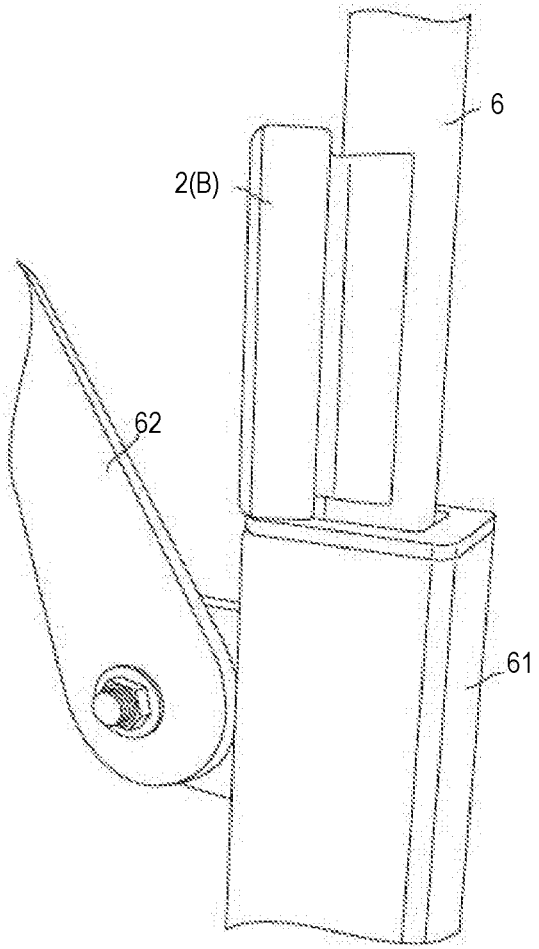
FIG. 31 is an alternative perspective side elevated view schematic representation of the second interlocking part up against a guide rod and on top of a safety stop of a Smith Machine, according to an embodiment.
Figure 32:
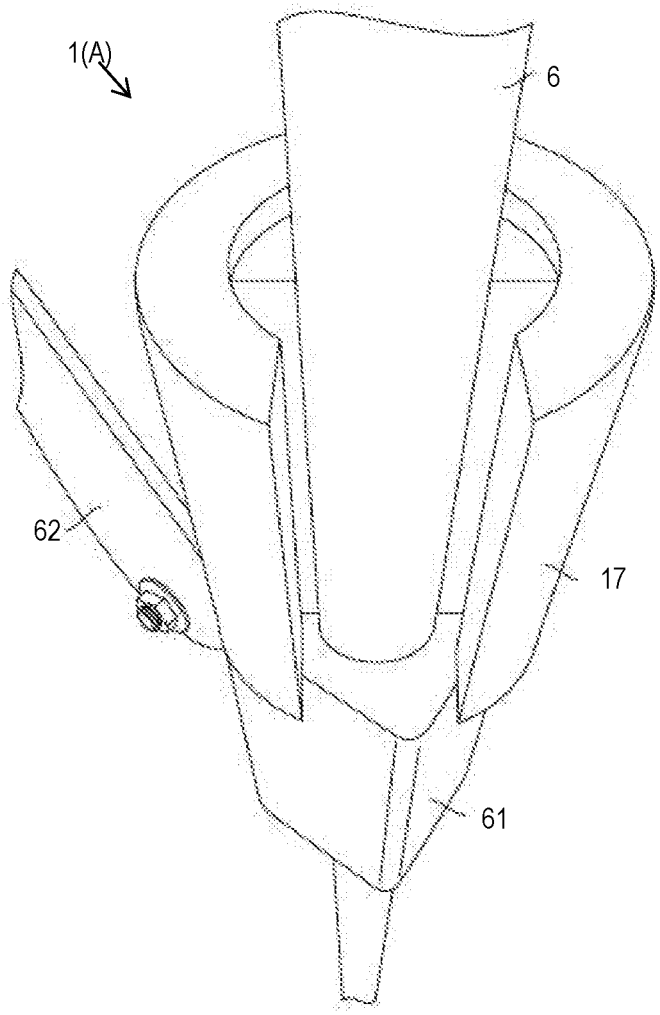
FIG. 32 is a perspective top angled view schematic representation of the first interlocking part around a guide rod of the Smith Machine, according to an embodiment
Figure 33:
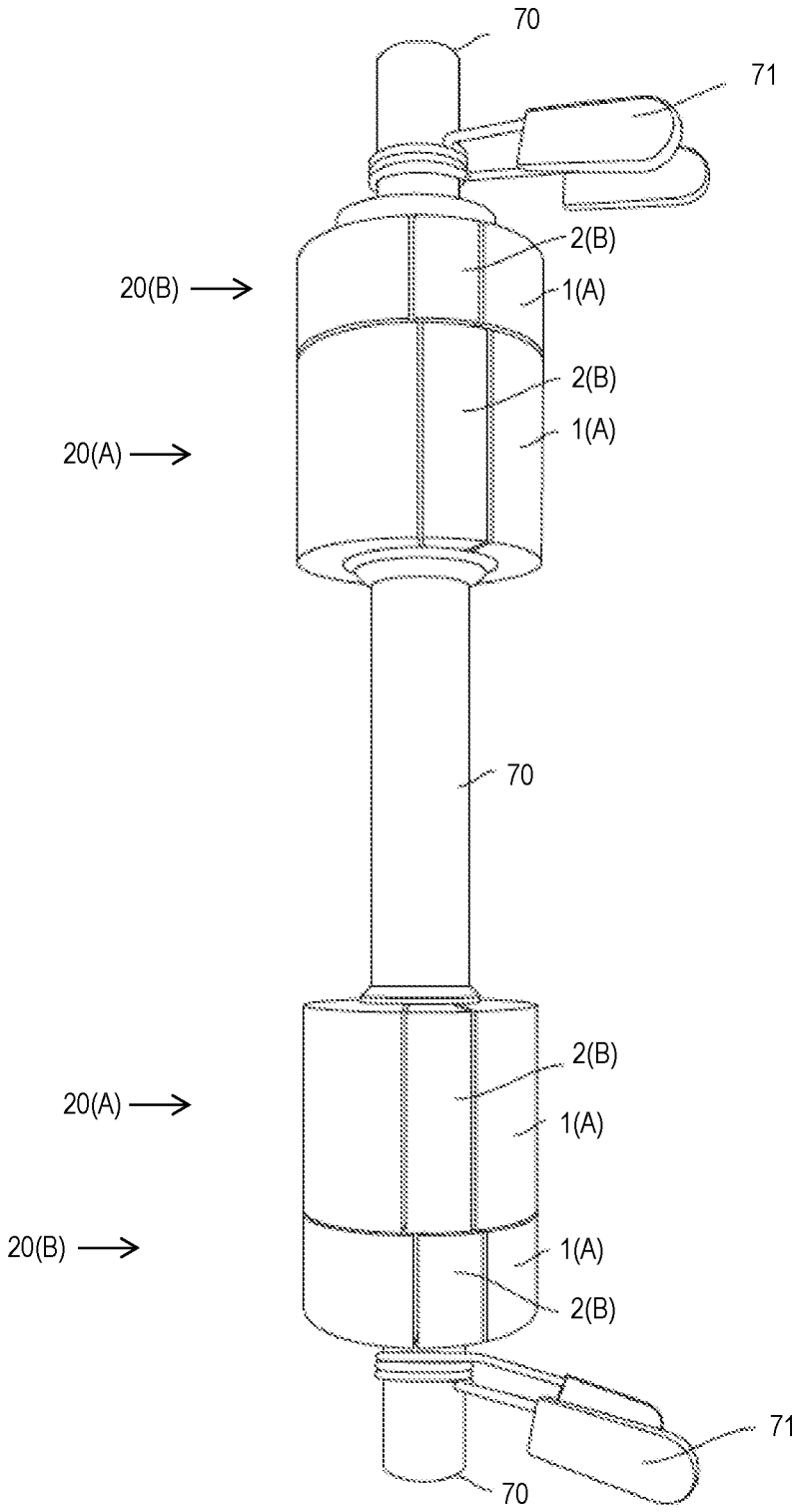
FIG. 33 is a perspective front view schematic representation of the spacer system on a dumbbell bar or dumbbell-like bar, according to an embodiment.
Figure 34:
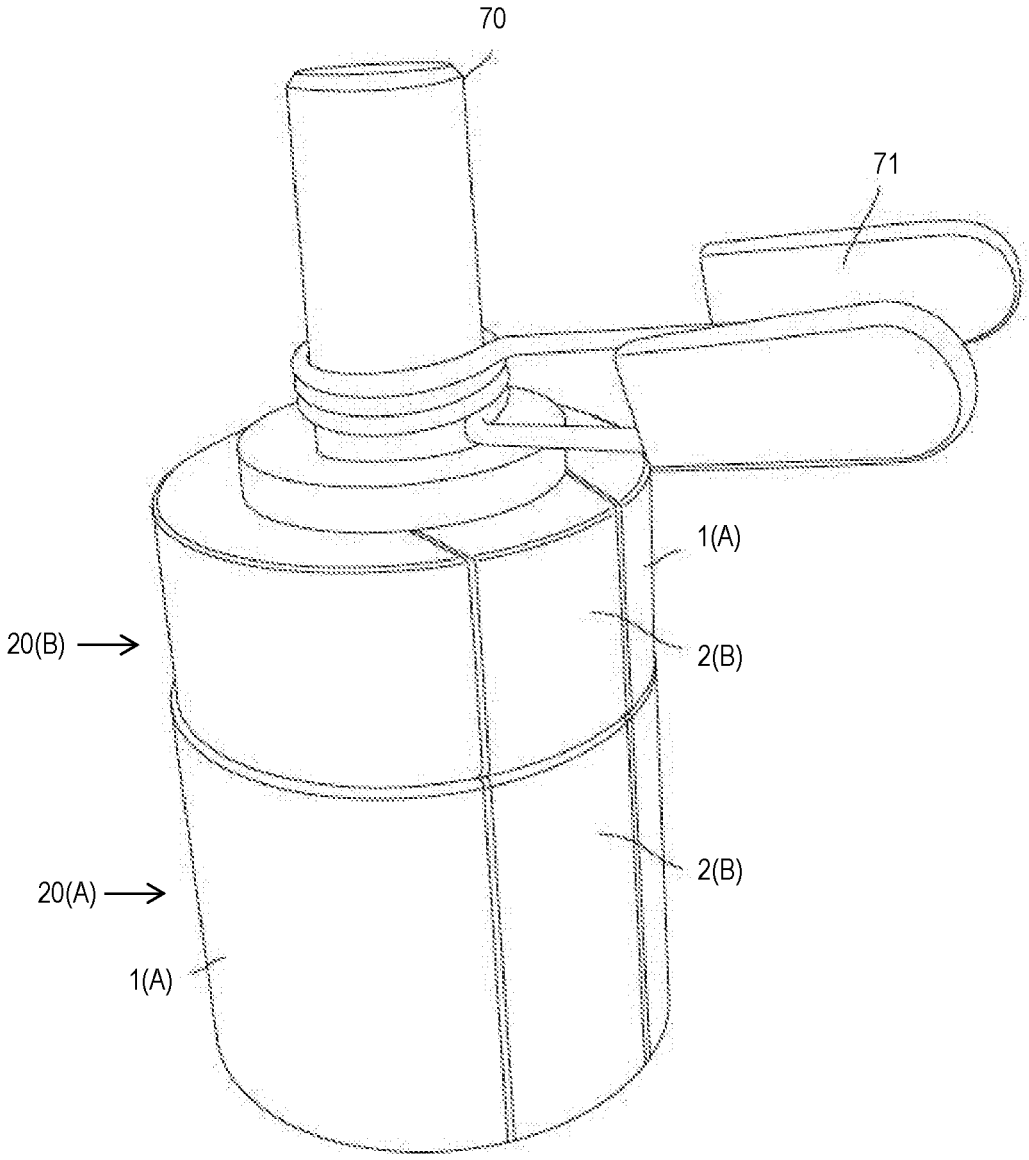
FIG. 34 is a close-up perspective front view schematic representation of the first end of the dumbbell in FIG. 33.

In FIG. 30, the second interlocking part 2(B) of the first spacer apparatus 20A is positioned around the guide rod 6 and on top of the safety stop sleeve 61. In particular, the inner perimeter 10 of the second interlocking part 2(B) abuts the guide rod 6. FIG. 31 shows an alternative perspective side view of the second interlocking part 2(B) of FIG. 30. FIG. 32 shows a perspective top elevated view of the first interlocking part 1(A) around a guide rod 6 on top of a safety stop sleeve 61. In the depicted embodiment, the first interlocking part 1(A) surrounds the guide rod 6 such that the inner perimeter 4 of the first interlocking part 1(A) abuts the guide rod 6.

A user can lock the first spacer apparatus 20A around the guide rod 6 by placing the second interlocking part 2(B) through the keyway 15 of the first interlocking part 1(A). Similarly, the keyway 15 of the first interlocking part 1(A) may be slidably moved over the key portion 11 of the second interlocking part 2(B).

Figure 35:
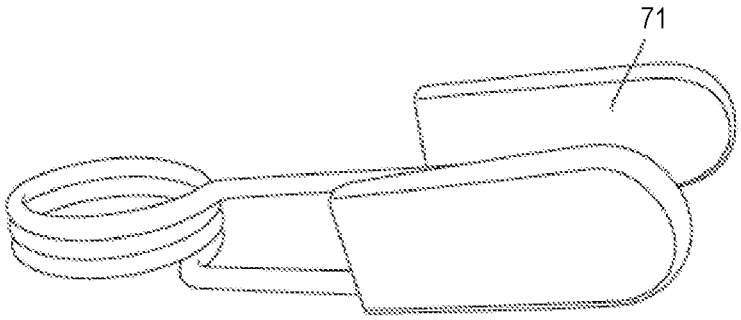
FIG. 35 is perspective view schematic representation of a clip, according to an embodiment.
Figure 36:
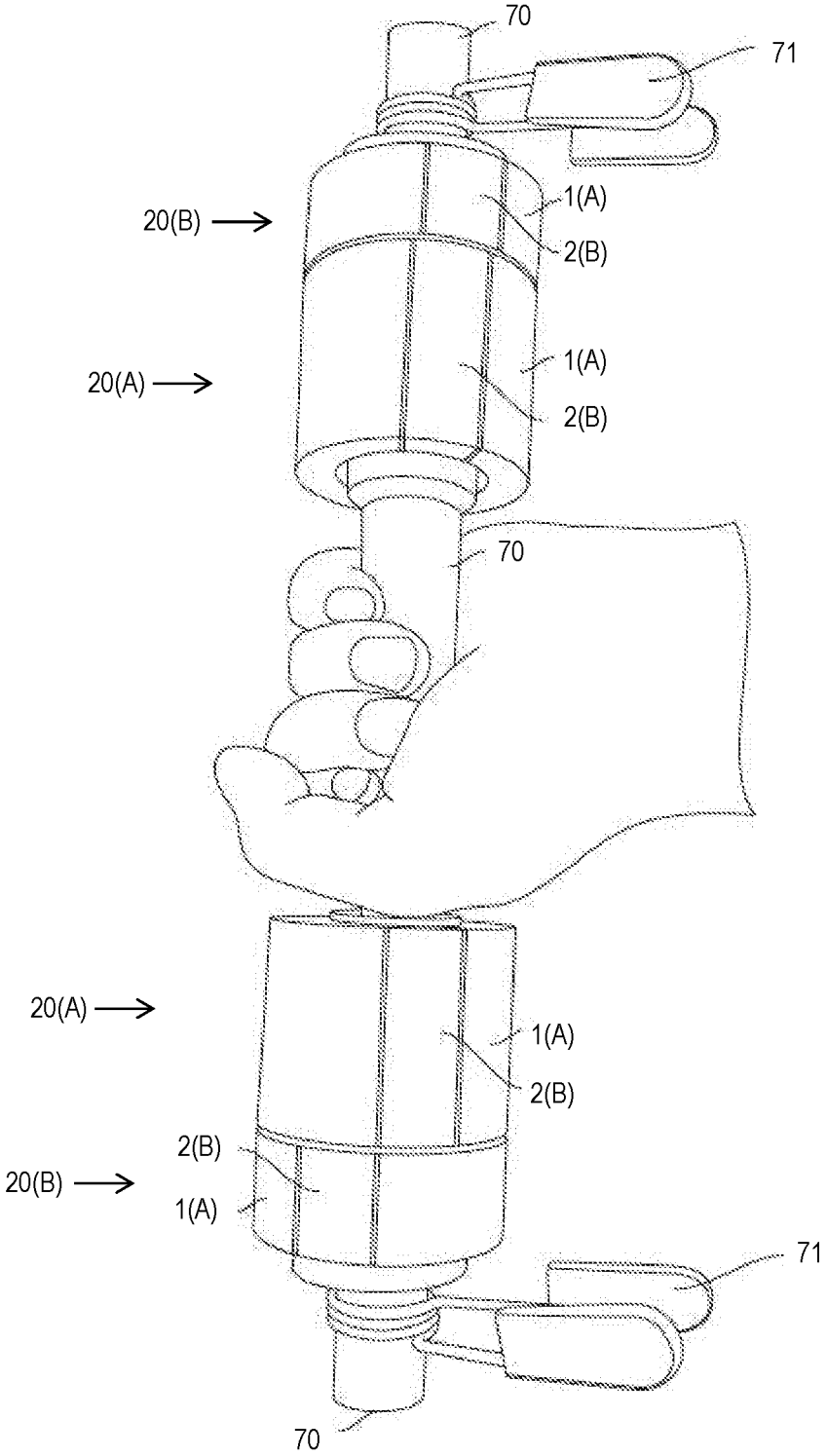
FIG. 36 is a perspective front view schematic representation of a user grasping the dumbbell of FIG. 32.

Referring now to FIGS. 33-38, there are shown various views schematic representations of the spacer system 100 in use on a dumbbell bar 70 for ease of handling, transporting, and storing. Similar to the placement of the spacer apparatuses 20A, 20B, 20C around the guide rod 6 in FIGS. 29-32, the spacer apparatuses 20A, 20B, 20C (not shown) can be interlocked around a dumbbell bar 70, pole, rod, or other cylindrical object for ease of handling, storing, and transporting. In some embodiments, a securing mechanism, such as the clip 71 shown in FIG. 35 is used to secure the spacer apparatuses 20A, 20B, 20C (not shown) around the dumbbell bar 70. Note, the embodiment of the clip 71 shown in FIGS. 33, 34, 35 and 36 is an exemplary conventional and known clip. As shown in FIG. 35, the clip 71 prevents the spacer apparatuses 20A, 20B, 20C (not shown) from sliding off an end 72, 73 of the dumbbell bar 70. With a clip 71 on both ends 72, 73 of the dumbbell bar 70, the user may easily transport the spacer system 100, as shown in FIG. 36. If the spacer system 100 is composed of a heavy metal material, the loaded dumbbell bar 70 shown in FIGS. 36-37 may also be used to perform weightlifting exercises.

Figure 37:
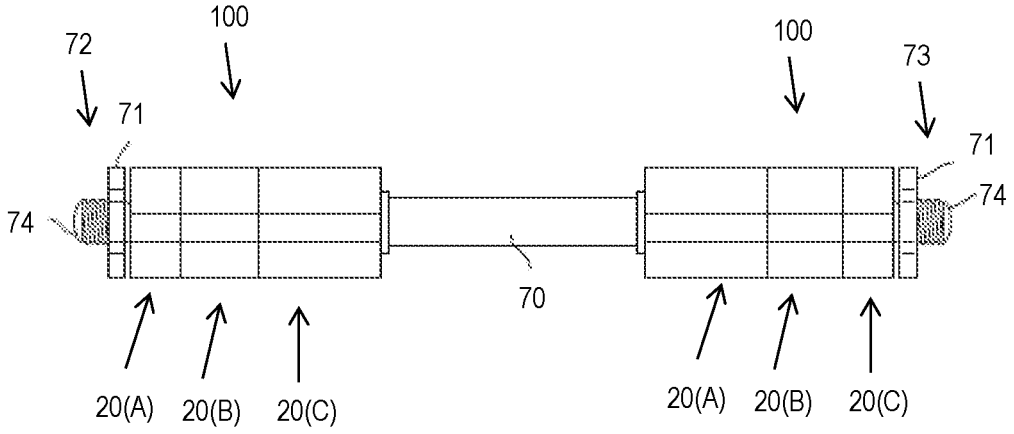
FIG. 37 is a perspective front view schematic representation of the spacer system on a dumbbell, according to an alternative embodiment.
Figure 38:
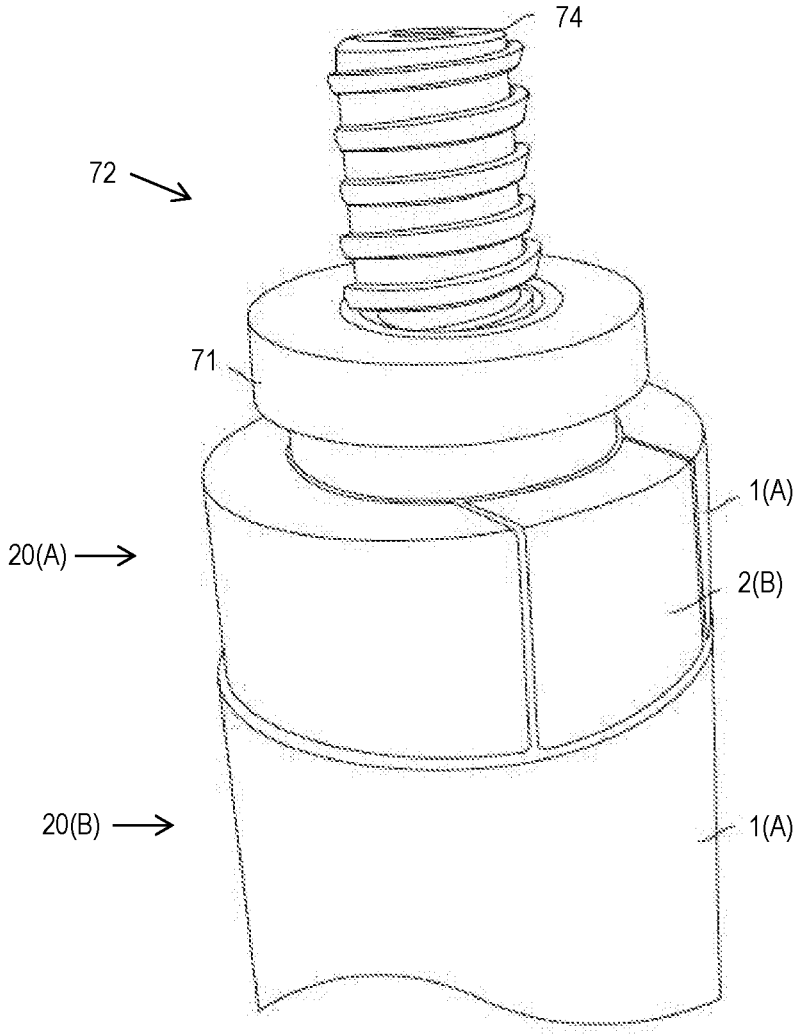
FIG. 38 is a close-up perspective front view schematic representation of the first end of the dumbbell in FIG. 37.

Turning now to FIGS. 37-38, there is shown various views schematic representations of an alternative embodiment of a securing mechanism. In the depicted embodiment, the securing mechanism comprises threads 74 on both ends 72, 73 of the barbell 70 and a connector 71 having corresponding threads. As shown in FIGS. 37 & 38, the connector 71 is secured to the barbell 70 by rotating the connector 71 around the threads 74 at the ends 72, 73 of the barbell 70.

Figure 39:
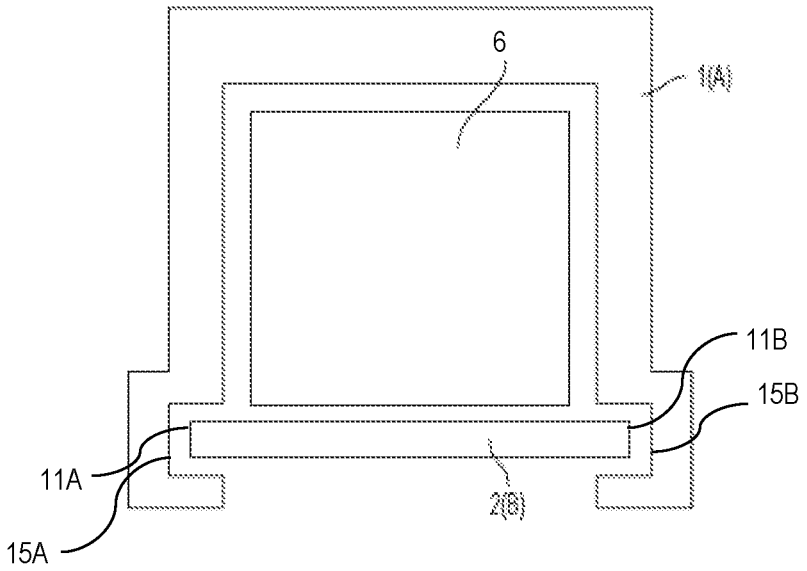
FIG. 39 is a top (and/or bottom) view schematic representation of a spacer apparatus according to a first rectangular embodiment.
Figure 40:
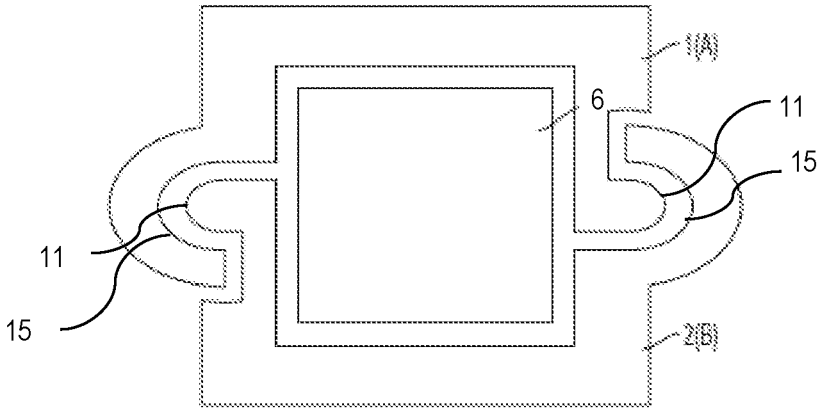
FIG. 40 is a top (and/or bottom) view schematic representation of a spacer apparatus according to a second rectangular embodiment.
Figure 41:
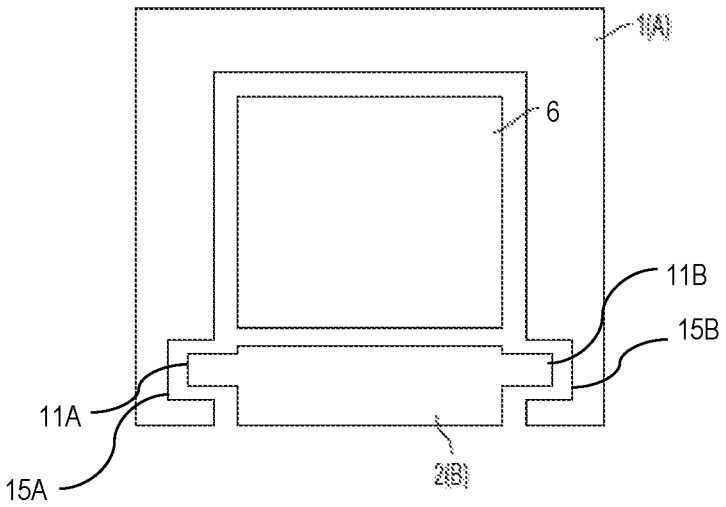
FIG. 41 is a top (and/or bottom) view schematic representation of a spacer apparatus according to a third rectangular embodiment.
Figure 42:
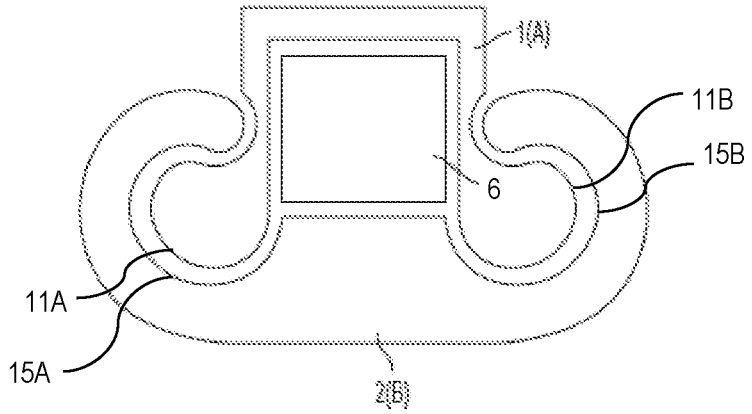
FIG. 42 is a top (and/or bottom) view schematic representation of a spacer apparatus according to a fourth rectangular embodiment.
Figure 43:
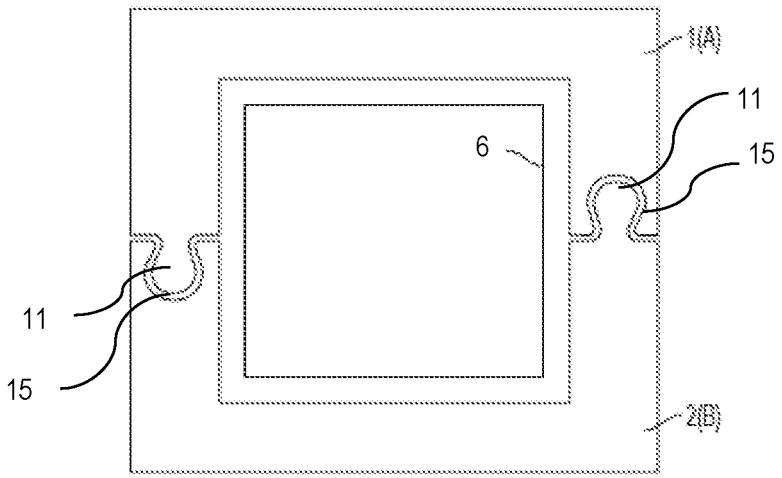
FIG. 43 is a top (and/or bottom) view schematic representation of a spacer apparatus according to a fifth rectangular embodiment.
Figure 44:
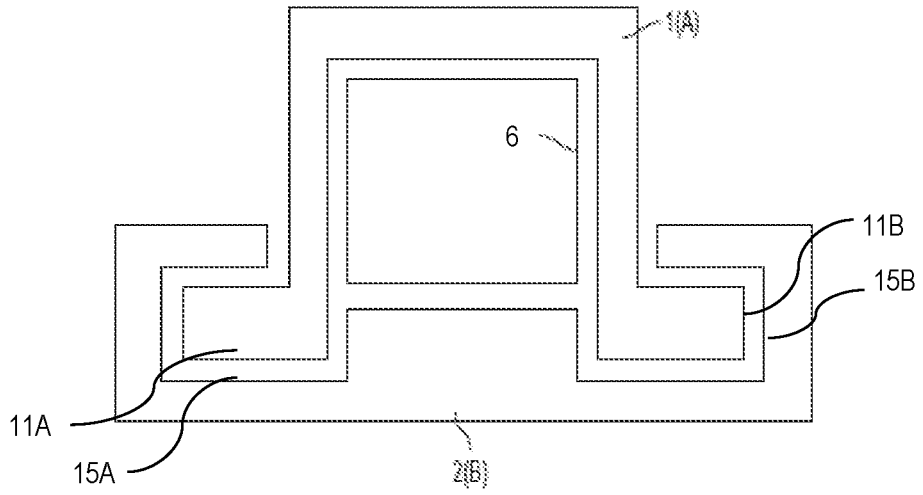
FIG. 44 is a top (and/or bottom) view schematic representation of a spacer apparatus according to a sixth rectangular embodiment.

Referring now to FIGS. 39-44, there are shown various views of a rectangular embodiment of the spacer apparatus 20. The rectangular embodiment of the spacer apparatus 20 may be used around a rectangular or square guide rod box 6, as shown in FIGS. 39-44. Rectangular embodiments of the spacer apparatus 20 may comprise a first interlocking part 1(A) with two male connectors 11A, 11B and a second interlocking part 2(B) with two female grooves 15A, 15B, as shown in FIGS. 42 and 44. The spacer apparatus 20 may also comprise a first interlocking part 1(A) with two female grooves 15A, 15B and a second interlocking part 2(B) with two male connectors 11A, 11B, as shown in FIGS. 39, 41. In other rectangular embodiments, the spacer apparatus 20 comprises interlocking part 1(A), 2(B) with both one male connector 11 and one female groove 15, as shown in FIGS. 40 and 43.

Figure 45:
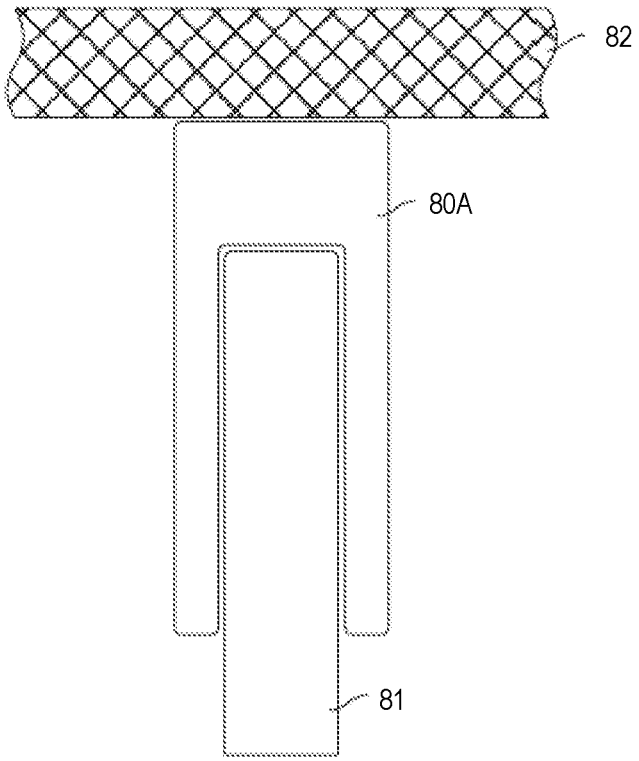
FIG. 45 is a side view schematic representation of a spacer apparatus, is use, according to a U-shaped embodiment.
Figure 46:
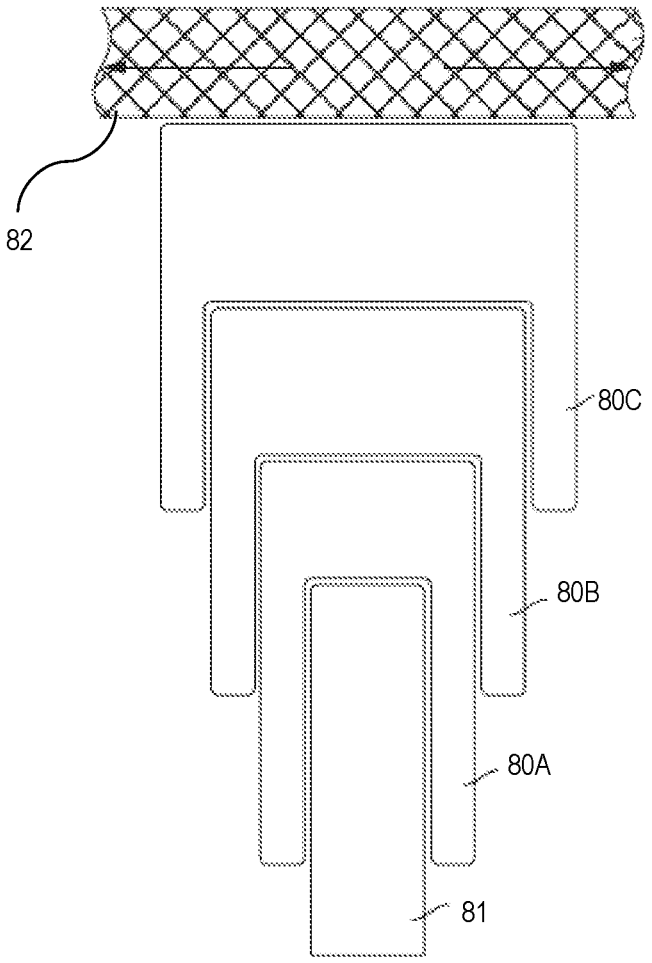
FIG. 46 is a side view schematic representation of a spacer system, is use, according to a U-shaped embodiment.
Figure 47:
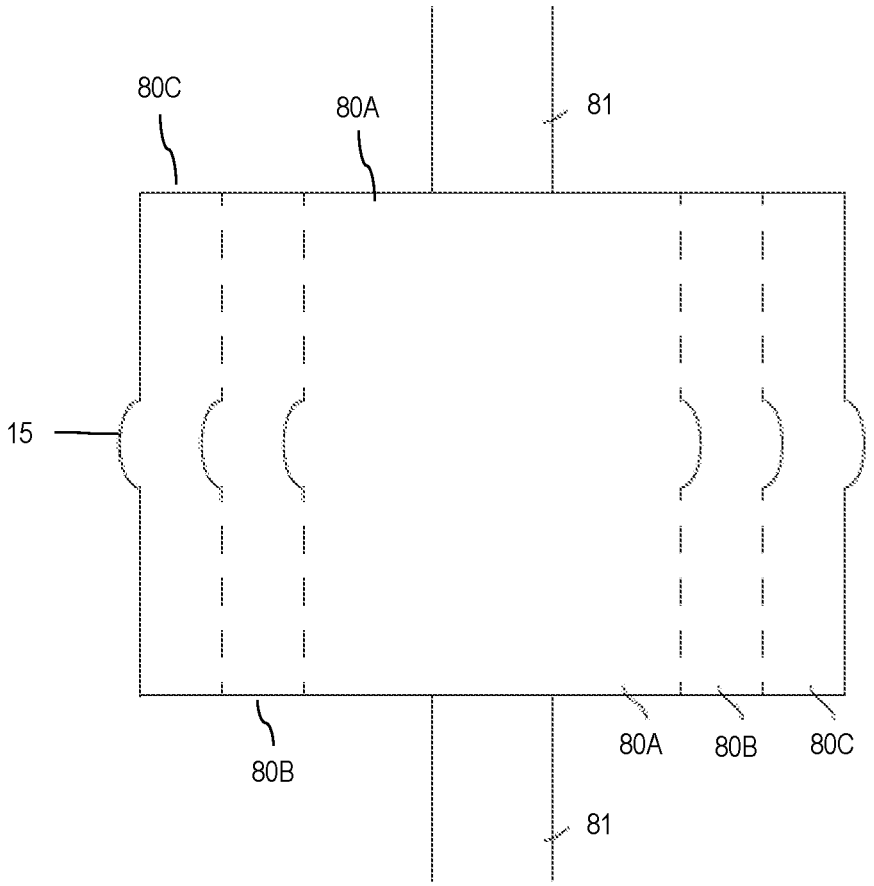
FIG. 47 is a top view schematic representation of a spacer system, is use, according to an alternative U-shaped embodiment.
Figure 48:
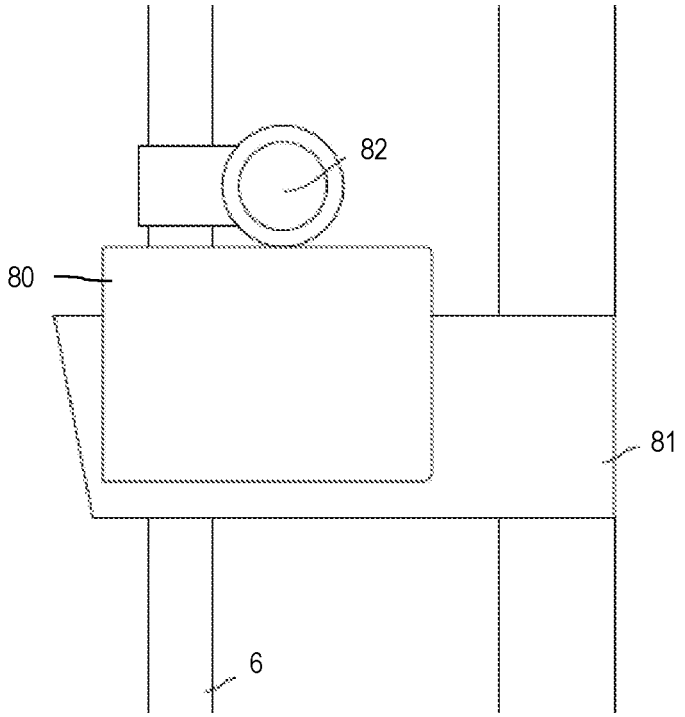
FIG. 48 is a side view schematic representation of a spacer system, is use, according to a mixed embodiment.
Figure 49:
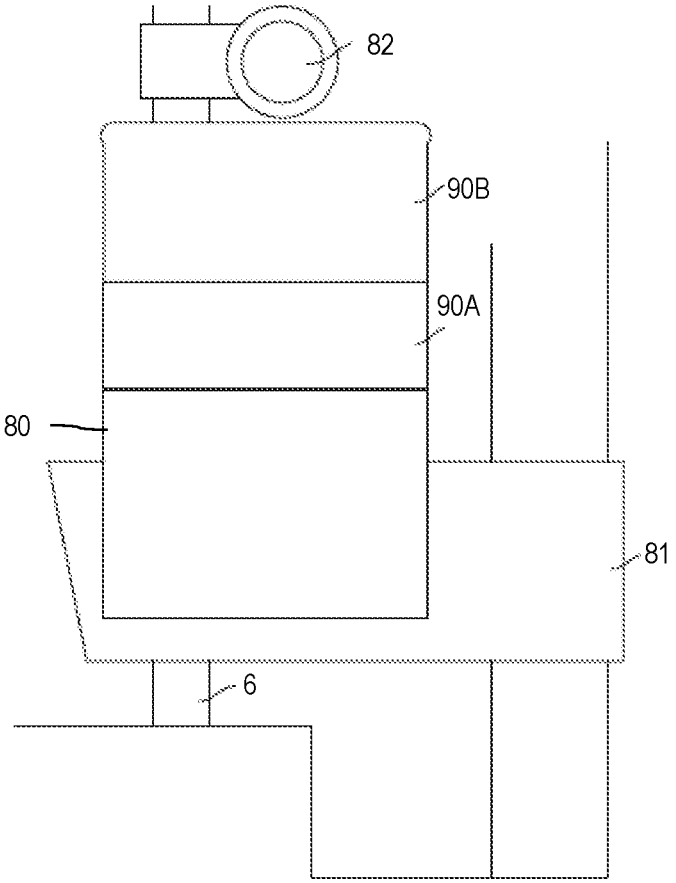
FIG. 49 is a side view schematic representation of the spacer system of FIG. 48.
Figure 50:
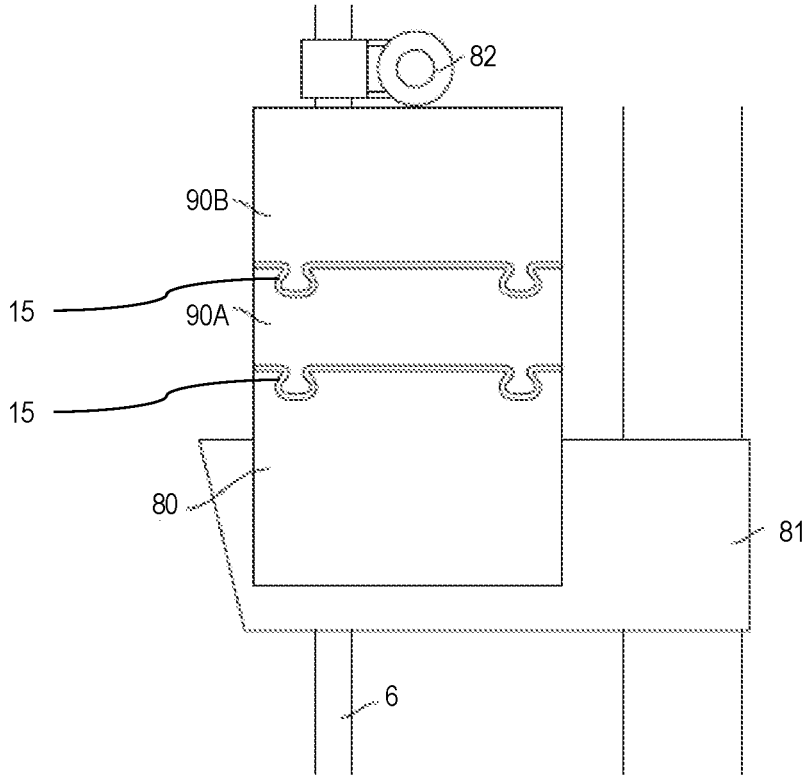
FIG. 50 is a side view schematic representation of a spacer system, is use, according to an alternative mixed embodiment.
Figure 51:
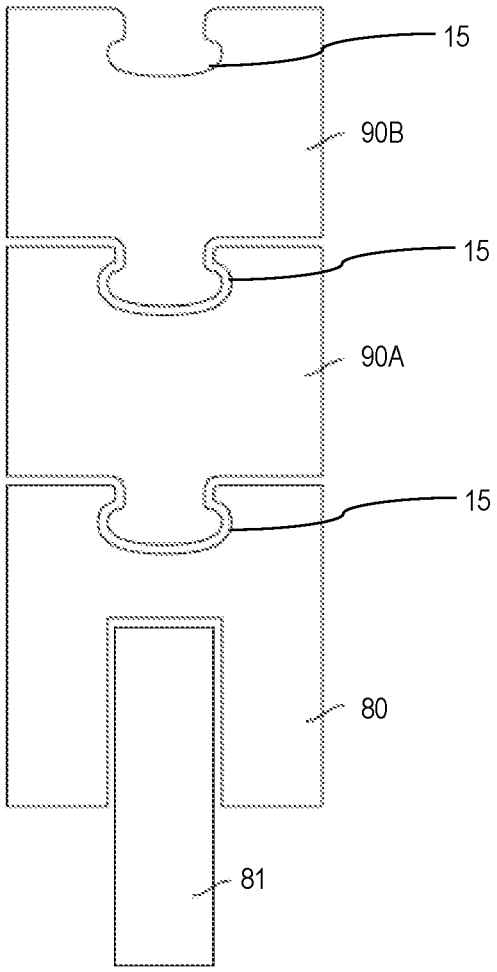
FIG. 51 close-up view schematic representation of the spacer system of FIG. 50.

Turning now to FIGS. 45-47, there are shown various views of a "U" shaped spacer system 100. The "U" shaped spacer system 100 relies on a nesting configuration to interlock over a safety stop 81 of the Smith Machine. In the depicted embodiment, the spacer apparatuses 80 are U-shaped and rectangular with approximately 90-degree edges. A first spacer 80A can be placed over and partially around the safety stop 81 of the Smith Machine, such that a barbell 6 moving downward will have its descent stopped when the bottom of the barbell 82 comes into contact with the top of the first spacer apparatus 80A as it sits on the safety stop 81. A second spacer 80B and a third spacer 80C may be stacked on the first spacer 80A in a nesting configuration. Thus, the third spacer 80C is larger than the second spacer 80B, which is larger than the first spacer 80A. Keyways 15, cushions 40, and other elements, such as those described in spacer apparatus 20 embodiments described above, can be incorporated into the top flat edge 82 of the U-shaped spacers 80A, 80B, 80C, as shown in FIG. 47. FIGS. 48-51 show a U-shaped spacer apparatus 80 with additional spacer apparatuses, 90A and 90B which are not U-shaped but which are bar-shaped, and attach to the top of each other and to the top of U-shaped spacer apparatus 80A by various keyways 15 to add additional height to the U-shaped spacer apparatus 80.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as, "has" and "having"), "include" (and any form of include, such as "includes" and "including"), and "contain" (any form of contain, such as "contains" and "containing") are open-ended linking verbs. As a result, a method or device that "comprises", "has", "includes" or "contains" one or more steps or elements. Likewise, a step of method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts and equivalents of all means or step plus function elements in the claims below, if any, are intended to include any structure, material or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of one or more aspects of the invention and the practical application, and to enable others of ordinary skill in the art to understand one or more aspects of the present invention for various embodiments with various modifications as are suited to the particular use contemplated.

What is claimed is:

1. A spacer apparatus for a weightlifting exercise machine, comprising:

a first interlocking part having a semi-circular body extending between a top portion and bottom portion with a lock portion extending between a first end and second end of the semi-circular body;

wherein the first end and the second end are spaced;

a keyway between the first end and second end;

a second interlocking part having a body extending between a top portion and a bottom portion, the body comprising a semi-circular portion and a key portion extending therefrom, the key portion extending between a first end and a second end of the body; and wherein in the interlocked configuration, the key portion extends between the keyway such that an outer perimeter of the first interlocking part and an outer perimeter of the second interlocking part are aligned.

2. The apparatus of claim 1, wherein the semi-circular body of the first interlocking part further comprises a first semi-circular countersunk area having a length which is less than a length of the lock portion.

3. The apparatus of claim 2, wherein the semi-circular portion of the second interlocking part is a second semi-circular countersunk area having a length which is less than a length of the key portion.

4. The apparatus of claim 3, wherein in the interlocked configuration, the first semi-circular countersunk area has a first pair of countersunk ends which abut a second pair of countersunk ends of the second semi-circular countersunk area.

5. The apparatus of claim 1, wherein in the interlocked configuration, a channel extends between the first interlocking part and the second interlocking part.

6. The apparatus of claim 1, wherein from the interlocked configuration, the second interlocking part slides out of the keyway to the unlocked configuration.

7. The apparatus of claim 3, further comprising a first inner perimeter of the first semi-circular countersunk area and a second inner perimeter of the second semi-circular countersunk area, wherein the first inner perimeter and second inner perimeter are aligned in the interlocked configuration.

8. The apparatus of claim 3, wherein the first interlocking part comprises a first outer countersunk perimeter between the lock portion and the first semi-circular countersunk area and the second interlocking part comprises a second outer countersunk perimeter between the key portion and the second semi-circular countersunk area, wherein, in the interlocked configuration, the first outer countersunk perimeter and the second outer countersunk perimeter are aligned.

9. The apparatus of claim 1, further comprising a first cushion connected to and extending along a top surface of the lock portion of the first interlocking part and a second cushion connected to and extending along a top surface of the key portion of the second interlocking part.

10. A spacer system for a weightlifting exercise machine, comprising:

a first spacer apparatus, comprising:

a first interlocking part with a first body extending between a top portion and a bottom portion and between a first end and second end of the first body;

wherein the first end and the second end are spaced;

at least one keyway between the first end and second end;

a second interlocking part having a second body extending between a top portion and a bottom portion, the second body comprising a key portion extending therefrom;

wherein in the interlocked configuration, the key portion extends into the keyway such that a first channel is formed between the first interlocking part and the second interlocking part; and an object is slidably received by the first channel.

11. The spacer system of claim 10, further comprising:

a second spacer apparatus, comprising:

a third interlocking part with a third body extending between a top portion and a bottom portion and between a first end and second end of the third body;

wherein the first end and the second end are spaced;

at least one keyway between the first end and second end;

a fourth interlocking part having a fourth body extending between a top portion and a bottom portion, the fourth body comprising a key portion extending therefrom;

wherein in the interlocked configuration, the key portion extends into the keyway such that a second channel is formed between the third interlocking part and the fourth interlocking part; and the object is slidably received by the second channel.

12. The spacer system of claim 11, wherein the object is a metal bar.

13. The spacer system of claim 10, wherein a cross-section of the first channel is circular.

14. The spacer system of claim 10, wherein a length of the first body is less than a length of the third body.

* * * * *